US009601265B2

(12) United States Patent
Sugino et al.

(10) Patent No.: US 9,601,265 B2
(45) Date of Patent: Mar. 21, 2017

(54) WIRELESS POWER TRANSMISSION APPARATUS AND DIRECT DRIVE TYPE SYSTEM INCLUDING THE APPARATUS

(71) Applicants: DENSO WAVE INCORPORATED, Chita-gun, Aichi-pref. (JP); DENSO CORPORATION, Kariya, Aichi-pref. (JP)

(72) Inventors: Masayoshi Sugino, Anjo (JP); Hiroshi Kondoh, Nagoya (JP); Shigeru Takeda, Okazaki (JP); Yasuyuki Haseo, Nishio (JP); Keisuke Hamasaki, Nukata-gun (JP)

(73) Assignees: DENSO WAVE INCORPORATED, Aichi-pref (JP); DENSO CORPORATION, Kariya (JP)

( * ) Notice: Subject to any disclaimer, the term of this patent is extended or adjusted under 35 U.S.C. 154(b) by 607 days.

(21) Appl. No.: 14/030,417

(22) Filed: Sep. 18, 2013

(65) Prior Publication Data

US 2014/0084699 A1 Mar. 27, 2014

(30) Foreign Application Priority Data

Sep. 26, 2012 (JP) ..... 2012-212340
Mar. 12, 2013 (JP) ..... 2013-049060
(Continued)

(51) Int. Cl.
*H01F 38/14* (2006.01)
*H01F 38/00* (2006.01)
*H01F 27/28* (2006.01)

(52) U.S. Cl.
CPC ..... *H01F 38/14* (2013.01); *H01F 27/2804* (2013.01)

(58) Field of Classification Search
USPC ..... 307/104; 108/21
See application file for complete search history.

(56) References Cited

U.S. PATENT DOCUMENTS 6,931,304 B1 * 8/2005 Miller ..... G11B 15/6835 369/30.34
2005/0161300 A1 7/2005 Green
(Continued)

FOREIGN PATENT DOCUMENTS

CN 101326706 A 12/2008
DE 202 09 092 U1 10/2003
(Continued)

OTHER PUBLICATIONS

Oct. 21, 2015 Office Action issued in German Patent Application No. 10 2013 110 341.3.
(Continued)

*Primary Examiner* — Rexford Barnie
*Assistant Examiner* — Xuan Ly
(74) *Attorney, Agent, or Firm* — Oliff PLC

(57) ABSTRACT

A direct drive type system such as a direct drive type robot is provided. This system includes a rail member, a movable member guided by the rail member and movable along the rail member, and an electric motor to drive the movable member. The system includes a transmission coil and a reception coil. The transmission coil has plural transmission coil segments which are planar coils and arranged on and along the rail member. High-frequency power is supplied to the transmission coil from a power source. The reception coil is arranged on the movable member to be opposed to the transmission coil and configured to an area faced with each of the transmission coil segments, wherein the area is smaller than that of each transmission coil segment. The reception coil receives power from the transmission coil
(Continued)

without contact by a magnetic resonance. The received power is supplied to the motor.

17 Claims, 23 Drawing Sheets

(30) Foreign Application Priority Data

Mar. 12, 2013 (JP) ..... 2013-049061
Mar. 22, 2013 (JP) ..... 2013-060127

(56) References Cited

U.S. PATENT DOCUMENTS

| | | | |
|---|---|---|---|
| 2005/0268313 | A1 | 12/2005 | Goodman et al. |
| 2009/0223697 | A1 | 9/2009 | Furuichi |
| 2010/0031856 | A1 | 2/2010 | Shoda et al. |

FOREIGN PATENT DOCUMENTS

| | | | | |
|---|---|---|---|---|
| DE | 20209092 | | * | 10/2003 |
| JP | H05336607 | | * | 6/1992 |
| JP | H05-336607 | A | | 12/1993 |
| JP | 2002-084687 | A | | 3/2002 |
| JP | A-2009-208941 | | | 9/2009 |
| JP | 2011-045045 | A | | 3/2011 |
| JP | 2011045045 | | * | 6/2011 |
| WO | 01/73783 | A1 | | 10/2001 |

OTHER PUBLICATIONS

Feb. 27, 2015 Office Action issued in Chinese Patent Application No. 201310430035.4.

* cited by examiner (SPECIFICATION OF COIL MEMBER: 20 TURNS, LINE WIDTH d: 2 mm, COIL DIAMETER D: 150 mm)

(SPECIFICATION OF COIL MEMBER: 20 TURNS, LINE WIDTH d: 2 mm, COIL DIAMETER D: 150 mm)

[COMPARATIVE EXAMPLE 1]

[COMPARATIVE EXAMPLE 2]

WIRELESS POWER TRANSMISSION APPARATUS AND DIRECT DRIVE TYPE SYSTEM INCLUDING THE APPARATUS

CROSS-REFERENCE TO RELATED APPLICATION

This application is based on and claims the benefit of priorities from earlier Japanese Patent Application Nos. 2012-212340, 2013-049060, 2013-050127 and 2013-049061 filed Sep. 26, 2012, Mar. 12, 2013, Mar. 22, 2013 and Mar. 12, 2013, the descriptions of which are incorporated herein by reference.

BACKGROUND OF THE INVENTION

[Technical Filed]

The present invention relates to a wireless power transmission apparatus and a direct drive type system including the apparatus, and in particular to a wireless power transmission apparatus based on a magnetic resonant method and a direct drive type system including the apparatus.

[Related Art]

Direct drive type systems have been in heavy use such as in factories. Such a direct drive type system includes a movable member that can move along a fixed rail member. As an example of the direct drive type system, a direct drive type robot is well known as disclosed such as in JP-A-2009-208941.

The direct drive type robot includes a fixed linear or curved rail member and a movable member that moves along the rail member. The movable member is supported and guided by the rail member. The movable member has a motor and moves along the rail member using the drive force of the motor. In the direct drive type robot, electric power is fed from a power source to the motor, The electric power is fed to the motor by way of a plurality of power cables housed in a cable carrier. The cable carrier is a flexible casing that houses, supports and guides piping and the power cables. Such a casing is well known as a cableveyor (trademark).

The cable carrier that houses the power cables is necessary between a power source and the movable member. The cable carrier is required to follow the movable member that moves along the rail member. Accordingly, the cable carrier is required to be set up in conformity with the moving range of the movable member. As the moving range of the movable member increases, the entire length of the cable carrier increases. In order to be in concert with the reciprocal movement of the movable member along the rail member, the cable carrier is used in a state where at least a part thereof is turned over in a shape of U.

However, in a direct drive type robot including such a cable carrier, inevitably, the movable member moves being accompanied by the cable carrier. Therefore, the output of the motor that drives the movable member is required to cover not only the weight of the movable member and the weight of the member conveyed by the movable member, but also the weight of the cable carrier. As a result, with the increase of the output of the motor, the size of the motor is increased.

Further, since the cable carrier moves with the movable member, the cable carrier is repeatedly brought into contact with the peripheral members. The contact between the cable carrier and the peripheral members causes noises. Further, the abrasion generates dust. In particular, in manufacturing facilities for precision equipment, such as electronic equipment and semiconductors, dust may cause quality loss of the products.

Direct drive type robots based on conventional art, which include a carrier that causes abrasion, are required to be improved so as to be more favorably applied to such manufacturing facilities.

A main purpose of introducing robots to facilities is to enhance work efficiency in the facilities. In a direct drive type robot, the movable member that moves along the rail member repeatedly moves along the rail member and stops at an optionally selected position for a predetermined work. The stop position and the moving distance of such a movable member are optionally set by users and thus depend on the facilities that introduce the direct drive type robot.

In a direct drive robot based on conventional art that includes a cable carrier as described above, the movable member receives supply of electric power by way of the cable carrier. Accordingly, supply of electric power to the movable member never stops, irrespective of the stop position and the moving distance of the movable member. In other words, if the cable carrier is not used, it is necessary to stably feed electric power to the movable member.

In addition, in the facilities introduced with the direct drive type robots, lots of machines other than the robots are at work. Therefore, in eliminating the cable carriers, it is necessary to consider that the elimination will not affect machines other than the robots.

SUMMARY OF THE INVENTION

The present invention has an object of providing a direct drive type system, such as a direct drive type robot, which is eliminated with a cable carrier to not only reduce the size of the movable member but also reduce the size of the machine as a whole, suppress generation of noises and dust, reduce electromagnetic influence on other machines, and increase applicable facilities.

The present invention has another object of providing a wireless power transmission apparatus for a direct drive type robot, which achieves transmission of electric power and enables easy adjustment of resonance frequency in performing wireless power transmission using power transmission-side and power reception-side coil members, with a simple structure and without using a cable carrier.

The present invention has still another object of providing a wireless power transmission apparatus for a direct drive type robot, which achieves transmission of electric power and reduces emission of noises in performing wireless power transmission using power transmission-side and power reception-side coil members, without using a cable carrier.

The present invention has still another object of providing a power transmission coil assembly for a direct drive type robot, which achieves transmission of electric power and enables easy change of a power transmission-side length, without using a cable carrier.

The present invention has the following features which are common to various modes of the present invention.

1) A variable member includes a power reception coil. The power reception coil is opposed to a power transmission coil which is provided to a rail member. The power reception coil receives electric power needed for driving a motor from the power transmission coil without contacting therewith, due to a magnetic resonance (or a magnetic field resonance) that occurs between the power reception coil and the power transmission coil. Thus, there is no need to use a power cable for supplying the drive force of the motor, or a cable carrier that houses the power cable.

2) Electric power is fed from the power transmission coil to the power reception coil in a non-contact manner. Accordingly, noises and abrasion resulting from the mutual contact between members is greatly reduced, and thus generation of dust resulting from the abrasion is also greatly reduced. Further, since the motor of the movable member receives supply of electric power in a non-contact manner, the motor does not have to integrally move with a cable carrier. Accordingly, the output required of the motor is more reduced. Reduction of the output of the motor leads to reducing the size of mechanical configuration, such as a circuit for feeding electric power to the motor and a transmission mechanism.

3) Furthermore, the power transmission coil includes a power transmission coil segment which is formed of a planar coil. Formation of the power transmission coil into a planar shape can reduce the volume along the rail member, which is needed for setting up the power transmission coil. Thus, it is not only that reduction in the size of the motor and the movable member is accelerated, but also that the size of the entire machine is reduced. At the same time, generation of noises and dust can be reduced and thus the applicable facilities are increased.

According to an aspect of the present invention, in the power reception coil and the power transmission coil, which are opposed to each other, the area of the power reception coil is ensured to be smaller than that of the power transmission coil segment. Also, magnetic resonance uses a high-frequency band of several MHz to several tens of MHz. Accordingly, when the power transmission coil and the power reception coil are not in face-to-face relation, transmission of high-frequency electric power to the power transmission coil drastically raises the impedance of the power transmission coil. Specifically, making use of magnetic resonance, current will flow only in a portion in which the power transmission coil segment of the power transmission coil faces the power reception coil, and current will hardly flow in a portion in which the power transmission coil segment of the power transmission coil does not face the power reception coil. In particular, by configuring the power transmission coil with a plurality of power transmission coil segments, current hardly passes through the plurality of power transmission coil segments except the one that faces the power reception coil. As a result, when high-frequency electric power is supplied to the power transmission coil, emission of electromagnetic noises is limited to only a part of the power transmission coil segment actually facing the power reception coil. Thus, the remaining part of the power transmission coil segment, which is not opposed to the power reception coil, and the rest of the power transmission coil segments will hardly emit electromagnetic noises.

As described above, in manufacturing facilities such as of electronic equipment and semiconductors, it is required to remove not only dust but also the influence of unnecessary electromagnetic noises. As in the present invention, use of non-contact power transmission based on a magnetic resonance can extremely limit the region where the electromagnetic noises are emitted, as described above. Accordingly, in a state where the power transmission coil is arranged along the rail member to constantly pass current through the power transmission coil, the influence of electromagnetic noises is hardly exerted at positions other than the position at which the power transmission coil faces the power reception coil, i.e. other than the position where the movable member is present. Accordingly, generation of not only noises and dust but also electromagnetic noises can be reduced. Thus, applicable facilities can be increased. Further, the movable member that includes the power reception coil with an area smaller than that of the power transmission coil segment, will face any one of the power transmission coil segments, whichever position along the rail member it may be located. Therefore, the movable member can be fed with electric power from the opposed power transmission coil segment, irrespective of the stop position and the moving distance of the movable member. Accordingly, the movement of the movable member is reliably ensured.

When non-contact power transmission is performed based on magnetic resonance, high-frequency current is required to be adjusted so as to range, for example, from several MHz to several tens of MHz which is suitable for magnetic resonance. In this case, the power transmission-side and power reception-side coil members are connected to a capacitor for adjusting frequency. When comparatively large electric power is dealt with, as in the direct drive type robot, the capacitor is required to have high durability against voltage and current. Therefore, prior to the adjustment of frequency, the necessity of high durability of the capacitor will cause increase in the size of the capacitor, leading to complicating the manufacturing process in mounting parts. If the capacitor is provided between layers of the substrate for mounting the coil member, alternating-current coupling may occur between the coil member and the electrodes of the capacitor to lower the Q value of resonance, to thereby problematically impair the function of the coil member.

According to another aspect of the present invention, a plate-like electrode member is provided on a rear surface side of a substrate, which is opposite to a coil member, being interposed by the substrate. Thus, the substrate is sandwiched between the coil member and the electrode member to thereby form a capacitor. Further, a reactance is formed by the coil member that is overlapped with the electrode member. The capacitor and the reactance formed in this way cause resonance. Resonance frequency is adjusted by changing the conditions of overlap between the electrode member and the coil member, the conditions including the size, the shape and the arrangement of the electrode member, or the thickness of the substrate. Thus, resonance frequency can be easily adjusted without increasing the size of parts, without complicating the process and without reducing the Q value, of resonance.

According to still another aspect of the present invention, a power reception coil unit sandwiches a power transmission coil unit from front surface side and rear surface side of the power transmission coil. The power transmission coil unit includes a power transmission coil provided to a substrate. The power reception coil unit includes a first coil opposed to the front surface of the power transmission coil unit, and a second coil opposed to the rear surface of the power transmission coil unit. The power reception coil unit sandwiches the power transmission coil unit with these first and second coils. With the structure as mentioned above, the efficiency of wireless power transmission is enhanced compared to the case where only the first coil is provided. In this case, leaked magnetic flux that has not contributed to wireless power transmission induces noises. In this regard, by allowing the rear surface of the substrate to face the second coil, leakage of magnetic flux is shielded by the second coil, while also causing magnetic resonance between the power transmission coil and the second coil. In other words, by arranging the second coil on a rear surface side of the substrate aiming at enhancing transmission efficiency of electric power, it is not only that the transmission efficiency is enhanced but also that noises are reduced. Thus, emission of noises induced by the leakage of magnetic flux is reduced and at the same time transmission efficiency is enhanced in transmitting electric power based on a magnetic resonance.

For example, in the above configuration, the first and second coils are planar coils and are wound in respective directions of establishing a mirror-image relationship, sandwiching the substrate. Thus, setting the winding directions of the first and second coils, reflectance between the power transmission coil unit and the power reception coil unit is lowered. In other words, transmission efficiency is enhanced in transmitting electric power from the power transmission coil unit to the power reception coil unit. Accordingly, the efficiency of transmitting electric power using a magnetic resonance can be more enhanced.

According to still another aspect of the present invention, an intermediate coil unit, a first-end coil unit and a second-end coil unit are provided. One or more intermediate coil units are connected so that the entire length of the connection can be optionally set. The first-end coil unit, which includes a fit return wiring part, is connected to one end portion of the connected intermediate coil units. The first return wiring part of the first-end coil unit and a second return wiring part of the second-end coil unit, when connected to a first coil wiring part and a second coil wiring part of the intermediate coil unit, will form a single serial-connection coil. Thus, establishing connection between one or more intermediate coil units, and first- and second-end coil units, a single roll of serial-connection coil is formed extending from the first-end coil unit to the second-end coil unit, with the interposition of the intermediate coil units. In other words, the serial-connection coil can be set to an optionally selected length by adjusting the number of intermediate coil units to be connected. Thus, the entire length of the power transmission-side coil can be easily changed.

In particular, in the configuration described above, the intermediate coil unit and the second-end coil unit each include a capacitor for adjusting resonance frequency. The capacitor is connected to the serial-connection coil. The entire length of the serial-connection coil that is on the power transmission side can be easily changed by changing the number of intermediate coils to be connected. On the other hand, change in the entire length of the serial-connection coil disturbs the resonance frequency for forming magnetic resonance. Elimination of the disturbance may involve, for example, troublesome work such as of adjusting the capacity of a variable capacitor that configures an LC circuit together with the serial-connection coil. To cope with this, the capacitor is provided to each of the intermediate coil unit and the second-end coil unit, for connection to the serial-connection coil. Thus, an LC circuit is formed in each of the intermediate coil unit and the second-end coil unit. In this way, resonance frequencies of the intermediate coil unit and the second-end coil unit are individually adjusted by the respective connected capacitors. Thus, the intermediate coil unit and the second-end coil unit, whose resonance frequencies are adjusted in advance, are connected to each other, eliminating the necessity of adjusting the resonance frequencies after connection. Accordingly, in changing the entire length of the power transmission-side coil, resonance frequencies can be easily adjusted.

DETAILED DESCRIPTION OF THE PREFERRED EMBODIMENTS

With reference to the accompanying drawings, hereinafter are described several embodiments of a wireless power transmission apparatus and a direct drive type system including the apparatus.

[First Embodiment]

Referring to FIGS. 1 to 5, hereinafter is described a wireless power transmission apparatus and a direct drive type system including the apparatus, according to the first embodiment.

In the first and the subsequent embodiments as well as their modifications, the direct drive type system is described as a direct drive type robot. However, the direct drive type system of the present embodiment is riot necessarily limited to the system or machine called direct drive type robot. In other words, if only the system or machine includes a fixed rail member, a movable member that is movable along the rail member, being supported and guided by a guide, such as a linear guide, and a wireless power transmission means based on a magnetic resonant method for transmitting electric power from the rail member to the movable member, the naming "direct driven" and "robot" are not necessarily insisted on. Further, the system or machine does not necessarily have to be an industrial system. For example, the system or machine may be the one that is set up on a wall of a corridor in a building to convey documents and the like.

Figure 1:
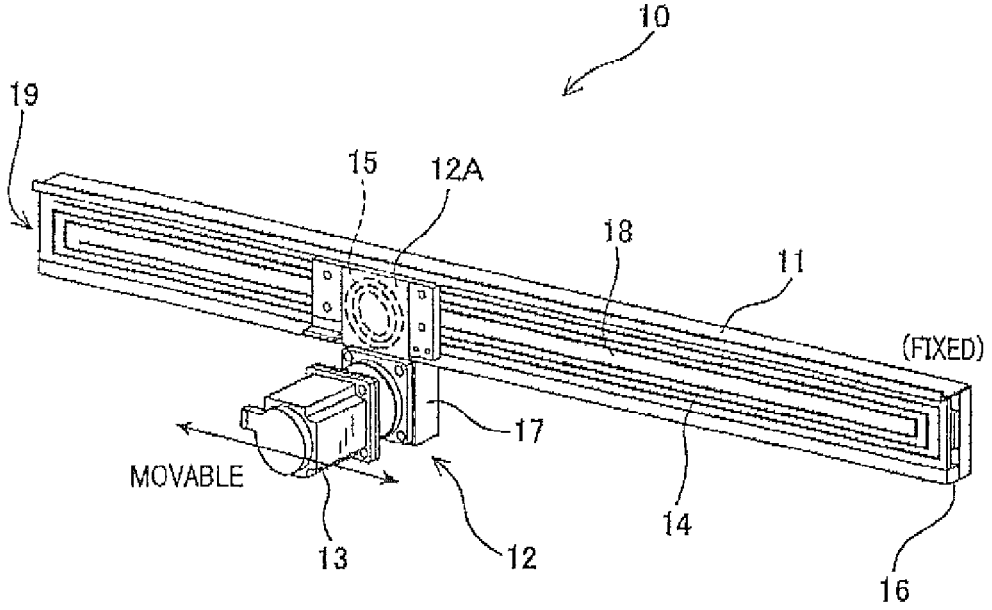
FIG. 1 is a schematic perspective view illustrating a direct drive type robot, according to a first embodiment of the present invention.

First, hereinafter is specifically described an example of a direct drive type robot according to the first embodiment:

As shown in FIG. 1, a direct drive type robot 10 (hereinafter also just referred to as "robot 10") includes a rail member 11, a movable member 12, an electric motor 13, a power transmission coil 14 and a power reception coil 15. The rail member 11 is formed into a linear shape or an optionally selected curved shape. The robot 10 is set up in a production facility, distribution facility and the like. For example, the rail member 11 is fixed to a facility on which the robot 10 is set up. The rail member 11 has a rack 16 (serving as a holding member) which is provided along the rail member 11. In the embodiment shown in FIG. 1, the rack 16 is provided to a lower end of the rail member 11.

The movable member 12 moves along the rail member 11 while being guided by the rail member 11. In other words, the movable member 12 moves relative to the rail member 11 fixed to the facility. The movable member 12 has a drive force transmission member 17 (serving as a moving member) which includes a pinion, not shown, that is engaged with the rack 16 of the rail member 11. The motor 13 is integrally provided with the movable member 12 and moves along the rail member 11 together with the movable member 12. The motor 13 supplies drive force to the drive force transmission member 17. The drive force of the motor 13 is transmitted to the rack 16 via the drive force transmission member 17. Thus, the pinion of the drive force transmission member 17 that is engaged with the rack 16 is rotated by the drive force of the motor 13, so that the movable member 12 can move relative to the rail member 11. The configuration of the robot 10 is not limited to the one in which the drive force of the motor 13 is transmitted to the rack 16 of the rail member 11 via the drive force transmission member 17. For example, the robot 10 may have a configuration in which an annular belt is provided to the rail member 11 and the movable member 12 moves relative to the rail member 11 using the frictional force generated in relation to the belt.

Figure 2:
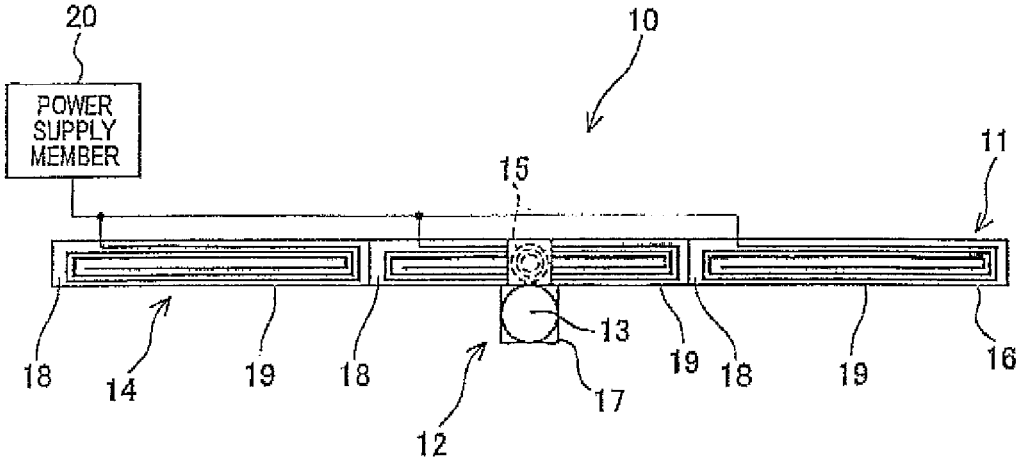
FIG. 2 is a schematic diagram illustrating the direct drive type robot, according to the first embodiment.
Figure 3:
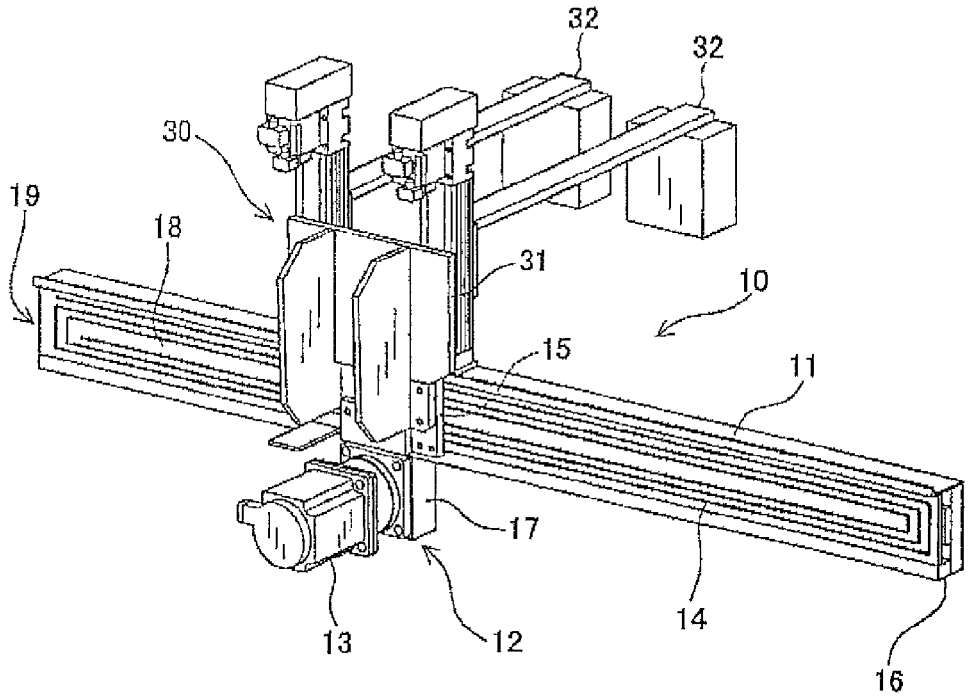
FIG. 3 is a schematic perspective view illustrating an application of the direct drive type robot, according to the first embodiment.

The power transmission coil 14 is provided along the rail member 11. The power transmission coil 14 is formed of a planar coil whose electric conductor is wound planarly, and provided to a side face of the rail member 11. Specifically, the power transmission coil 14 is planarly formed on a substrate 18 (i.e., transmission-side substrate (or base)) provided to the side face of the rail member 11. In the embodiment shown in FIG. 1, the power transmission coil 14 is provided, as a single power transmission coil segment 19 (hereinafter referred to as "coil segment 19" as well), to the rail member 11. The coil segment 19 is formed by winding, a plurality of times, a conductor according to an elongated rectangular winding pattern. As shown in FIG. 2, the rail member 11 may have a plurality of coil segments 19. In the example shown in FIG. 2, the rail member 11 includes three coil segments 19, which are formed on three elongated rectangular cascade-connected substrates 18, respectively. The direction along which the three coil segments 19 are cascade-connected agrees with the moving direction of the movable member 12. Each of these coil segments 19 is parallelly in contact with a power supply member 20. Thus, the coil segments 19 are fed with electric power from the power supply member 20. The distance that the movable member 21 can travel can be easily and optionally extended by configuring the rail member 11 by connecting a plurality of coil segments 19.

As shown in FIG. 1, the power reception coil 15 is provided on a substrate 12A (i.e., a reception-side substrate) arranged to the movable member 12, and integrally moves with the movable member 12 along the rail member 11, together with the motor 13 and the drive force transmission member 17.

Furthermore, the power transmission coil segments 19 and the power reception coil 15 are both formed as planar coils (or flat coils) produced by winding a conductor a plurality of times. This is formed by printed wiring, for example. The number of wound turns may be one. In the present embodiment, the coil segments 19 has an oval (or elongated rectangular) winding pattern, while the power reception coil 15 has a circular winding pattern. In addition, these coils can be produced as planar coils whose winding pattern is square. If a substrate is curved, curved coils can be formed on the curved substrate in conformity with its curvature, so that the planar shape is still maintained.

The power reception coil 15 is in a direct face-to-face relation with the power transmission coil 14 provided to the rail member 11, with a gap of a predetermined distance therebetween. From a viewpoint of a higher transmission efficiency of power, it is preferred that the coil face of the power reception coil 15 is directly opposed to the coil face of the power transmission coil 14, but according to design choices, both faces may be opposed to each other at a relative oblique angle.

The power reception coil 15 is formed such that its area facing the power transmission coil 14 will be smaller than the area of the coil segment 19. Specifically, the coil segment 19 here has a coil so area St that corresponds to an area inside its outermost winding. In contrast, the power reception coil 15 has a coil area Sr that corresponds to an area inside its outermost winding, wherein the coil area Sr is smaller than the coil area St. As described, the power reception coil 15 is also formed of a planar coil and the area Sr of the power reception coil 15 corresponds to an area inside the outermost coil of the power reception coil 15. Thus, the area Sr of the power reception coil 15 is ensured to be smaller than the area St of the power transmission coil segment 19.

The power transmission coil 14 and the power reception coil 15 are provided being spaced apart from each other interposed by a gap therebetween. Specifically, there is a distance of about several millimeters to several tens of millimeters between the power transmission coil 14 and the power reception coil so that the coils 14 and 15 will not be in contact with each other. Without being contact with each other, the power reception coil 15 receives electric power from the power transmission coil 14 using magnetic resonance (or magnetic field resonance). Specifically, the power reception coil 15 is not in contact with the power transmission coil 14 but receives electric power to be consumed such as by the motor 13 from the power transmission coil 14. The movable member 12 receives electric power from the power transmission coil 14 via the power reception coil 15 in a non-contact manner. Accordingly, when the length of the rail member 11 is optionally extended, there is no need of adjusting a cable and a cable carrier that would be used for supplying electric power to the movable member 12.

The direct drive type robot 10 as described above is provided with various functional parts in the movable member 12. For example, in an example shown in FIG. 3, the movable member 12 of the robot 10 has a lifting mechanism 30. For example, the lifting mechanism 30 drives stages 32 in a direction perpendicular to the moving direction of the movable member 12, using the drive force generated by a motive power source 31, such as a linear motor. In this case, the electric power necessary for actuating the motive power source 31 is fed through the non-contact power transmission performed between the power transmission coil 14 and the power reception coil 15, in a manner similar to the one for the motor 13 of the movable member 12.

Hereinafter is specifically described transmission of electric power in the direct drive type robot 10.

As shown in FIG. 2, the power supply member 20 supplies alternating current having a frequency as high as several MHz to several tens of MHz to the coil segments 19 configuring the power transmission coil 14 to establish magnetic resonance (or magnetic field resonance). For example, the high frequency supplied by the power supply member 20 is optionally determined in accordance with the characteristics of the power transmission coil 14 and the power reception coil 15 to establish magnetic resonance. When the power supply member 20 is turned on, current is passed to the power transmission coil 14. Thus, when current is passed to the power transmission coil 14, magnetic resonance occurs at a portion in which the power transmission coil 14 faces the power reception coil 15. Accordingly, the power reception coil 15 receives electric power from the power transmission coil 14 using the magnetic resonance. On the other hand, when current is passed to the power transmission coil 14 but the power transmission coil 14 does not face the power reception coil 15, unnecessary electric field and magnetic field are not emitted from the power transmission coil 14. Specifically, when current is passed to the power transmission coil 14, transmission and reception of electric power is performed using magnetic resonance in the portion in which the power transmission coil 14 faces the power reception coil 15. In contrast, in a portion in which the power transmission coil 14 does not face the power reception coil 15, neither transmission and reception of electric power is performed, nor electrical field and magnetic field are hardly emitted.

Figure 4:
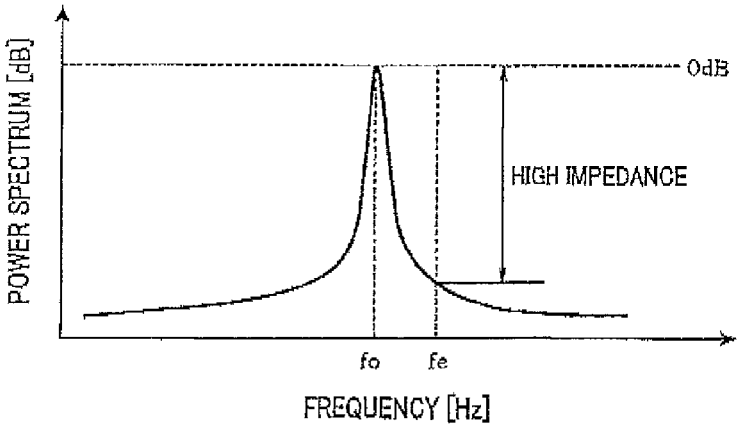
FIG. 4 is a schematic diagram illustrating resonance frequency in magnetic resonance, in a state where a power transmission coil and a power reception coil are not positioned face to face.
Figure 5:
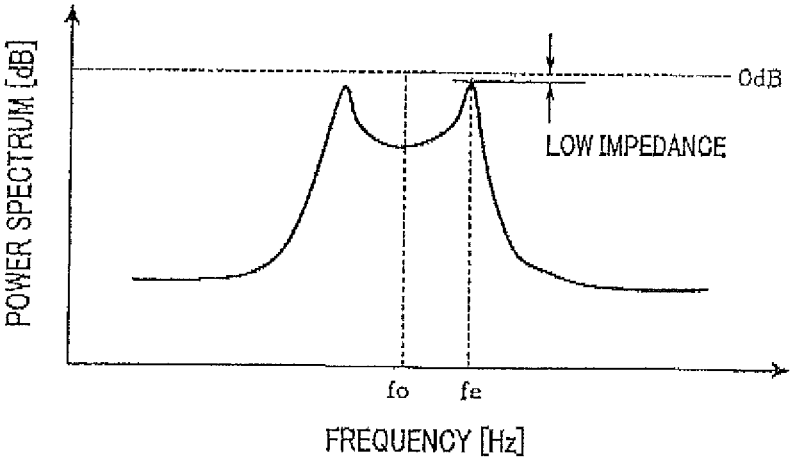
FIG. 5 is a schematic diagram illustrating resonance frequency in magnetic resonance, in a state where a power transmission coil and a power reception coil are positioned face to face.

The reasons for this are as follows. Specifically, here, a single body of the power transmission coil 14 configured by one or more coil segments 19 is defined to have a resonance frequency of $f_0$. Further, here, the resonance frequency caused by the magnetic resonance between the power transmission coil 14 and the power reception coil 15 is defined to be fe. As shown in FIG. 4, when the power reception coil 15 does not face the power transmission coil 14, an application of high frequency to the power transmission coil 14 drastically increases the impedance of the power transmission coil 14 at the resonance frequency fe caused by a magnetic resonance. Accordingly, in a portion in which the power transmission coil 14 does not face the power reception coil 15 and thus no magnetic resonance occurs, application of high frequency to the power transmission coil 14 hardly causes flow of current and thus emission of electric field and magnetic field hardly occurs. In contrast, as shown in FIG. 5, when the power transmission coil 14 faces the power reception coil 15, the impedance of the power transmission coil 14 is decreased at the resonance frequency fe caused by the magnetic resonance. Accordingly, in the portion in which the power transmission 14 and the power reception coil 15 face with each other to mutually cause magnetic resonance, current is permitted to flow to thereby supply electric power from the power transmission coil 14 to the power reception coil 15. Thus, feeding electric power from the power transmission coil 14 to the power reception coil 15 using magnetic resonance, unnecessary emission of electric field and magnetic field is decreased and emission of electromagnetic noises accompanying this is decreased.

As described above, according to an embodiment of the direct drive type robot, the power reception coil 15 faces the power transmission coil 14 provided to the rail member 11, and receives necessary electric power in a non-contact manner for actuating the motor 13, using magnetic resonance that occurs between the power reception coil 15 and the power transmission coil 14. Accordingly, the robot can eliminate the configuration involved in a power cable for supplying drive force to the motor 13 and a cable carrier for housing the power cable. Specifically, neither a power cable nor a cable carrier is required to be connected to the movable member 12. Accordingly, there is no need of adjusting the power cable and the cable carrier in conformity with the moving distance of the movable member 12.

Further, the non-contact power transmission performed between the power reception coil 15 and the power transmission coil 14 can drastically reduce the noises and abrasion that would result from the mutual contact between the members, and generation of dust that would result from the abrasion. Further, receiving electric power in a non-contact manner, the motor 13 of the movable member 12 is not required to move integrally such as with a cable carrier. Accordingly, the output requested to the motor 13 is smaller than in the configuration based on conventional art that uses a cable carrier. The small output of the motor 13 may lead to reducing the mechanical configuration such as of a circuit for feeding electric power to the motor 13 and of a transmission mechanism.

On the other hand, when the output of the motor 13 is not changed, a larger force is obtained for the activation of the movable member 12 to thereby increase objects that can be handled by the robot 10.

Further, the power transmission coil 14 includes the transmission coil segment 19 formed of a planar coil. Thus, formation of the power transmission coil 14 into a planar shape may allow the power transmission coil 14 to reduce the volume along the rail member 11, which is needed for setting up the power transmission coil 14. Specifically, the coil segment 19 configuring the power transmission coil 14 is provided along a wall surface of the rail member 11. Accordingly, the integration of the rail member 11 with the power transmission coil 14 does not invite expansion of the volume for setting up the rail member 11. Accordingly, not only that the size reduction of the motor 13 and the movable member 12 is accelerated, but also that the size of the machine as a whole can be reduced and generation of noises and dust can be reduced. As a result, applicable facilities are increased.

In the present embodiment, magnetic resonance is used for the electric power transmission performed between the power transmission coil 14 and the power reception coil 15. In the power transmission coil 14 and the power reception coil 15 facing each other, the area Sr of the power reception coil 15 is formed so as to be smaller than the area St of the opposed coil segment 19. With this configuration, electric power is transmitted and received due to the magnetic resonance, using high frequency of several MHz to several tens of MHz. Accordingly, when the power transmission coil 14 and the power reception coil 15 are not positioned face to face, supply of high-frequency electric power to the power transmission coil 14 drastically increases the impedance of the power transmission coil 14. Specifically, using magnetic resonance, current flow is cased only at a portion in which the power transmission coil 14 faces the coil segment 19, but hardly caused at a portion in which the coil segment 19 does not face the power reception coil 15. In particular, or the plurality of coil segments 19 configuring the power transmission coil 14, the one facing the power reception coil 15 will have a current flow but the rest of the coil segments 19 will hardly have a current flow.

As a result, even when high-frequency current is passed to the power transmission coil 14, emission of electromagnetic noises from the power transmission coil 14 is limited to the coil segment 19 facing the power reception coil 15, or specifically, to a portion of the coil segment 19, which portion actually faces the power reception coil 15. Accordingly, the remaining portion of the coil segment 19 facing the power reception coil 15 and the rest of the segment coils 19 will hardly emit electromagnetic noises. In manufacturing facilities such as of electronic equipment and semiconductors, not only dust but also the influence of unnecessary electromagnetic noises is required to be removed. In this regard, owing to the use of the non-contact power transmission based on magnetic resonance as in the present embodiment, the region where electromagnetic noises are emitted will be extremely limited to a portion in which the power transmission coil 14 and the power reception coil 15 are positioned face to face. Accordingly, in a state where the power transmission coil 14 is arranged along the rail member 11 for constant current supply to the power transmission coil 14, electromagnetic noises are hardly emitted and thus the influence of the electromagnetic noises is hardly exerted, except for the spot where the power transmission coil 14 faces the power reception coil 15, i.e. the spot where the movable member 12 is present. Thus, not only the generation of noises and dust but also the emission of electromagnetic noises can be reduced, thereby increasing applicable facilities, such as manufacturing facilities for electronic equipment and semiconductors.

In addition, the movable member 12 having the power reception coil 15 with an area smaller than that of the coil segment 19 is ensured to face any one of the coil segments 19 whichever position along the rail member 11 it may be located. Accordingly, the movable member 12 receives supply of electric power from the opposed coil segment 19, irrespective of the stop position and the moving distance of the movable member 12. Thus, the movable member 12 is ensured to be reliably activated.

(Modifications)

Figure 6:
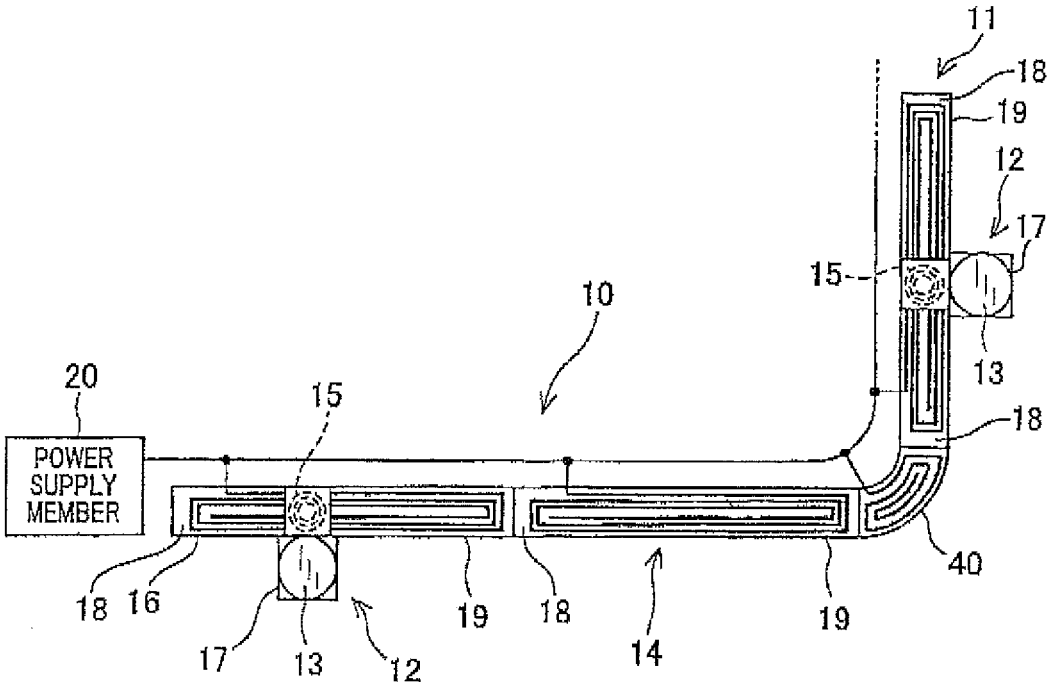
FIG. 6 is a schematic diagram illustrating a direct drive type robot, according to a modification of the first embodiment.

In the first embodiment described above, the rail member 11 is hinearly arranged. Alternatively, as shown in FIG. 6, the rail member 11 may be formed into a curved shape by providing a curved power transmission coil segment 40 at a midpoint of the linear coil segment 19. Thus, the movable member 12 becomes movable not only in a linear manner but also in a curved manner.

Figure 7:
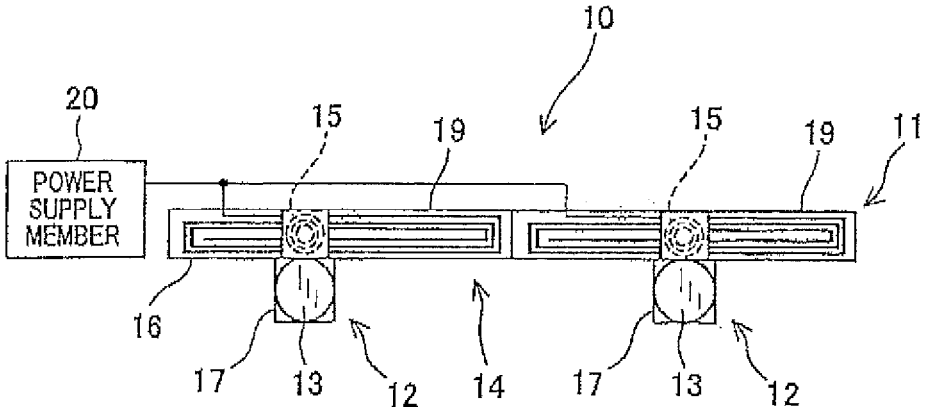
FIG. 7 is a schematic diagram illustrating a direct drive type robot, according to another modification of the first embodiment.

Further, in the first embodiment, the movable member 12 is solely provided for the rail member 11. Alternatively, as shown in FIGS. 6 and 7, two or more movable members 12 may be provided for the rail member 11. Thus, the two or more movable members 12 are able to individually receive electric power from the single rail member 11 that serves as an electric power source, whereby the movable members 12 can be activated reliably.

Further, in the first embodiment, the power transmission coil is provided to a side face of the rail member 11. Alternatively, the power transmission coil 14 may be provided to the upper surface of the rail member 11, i.e., the upper surface with respect to the direction of gravity, so that the movable member 12 can move above the power transmission coil 14.

[Second Embodiment]

Referring to FIGS. 8 to 18, hereinafter is described a second embodiment of a wireless power transmission apparatus and a direct drive type system including the apparatus.

The second and the subsequent embodiments as well as their modifications include description partially overlapped with the description of the configuration and effects of the first embodiment. However, taking account of the context and easiness of understanding of description, the partially overlapped description are permitted to remain without being removed. In addition, in the following descriptions, the power transmission and reception coils are also composed of planar coils, which are the same as those described in the first embodiment.

Figure 8:
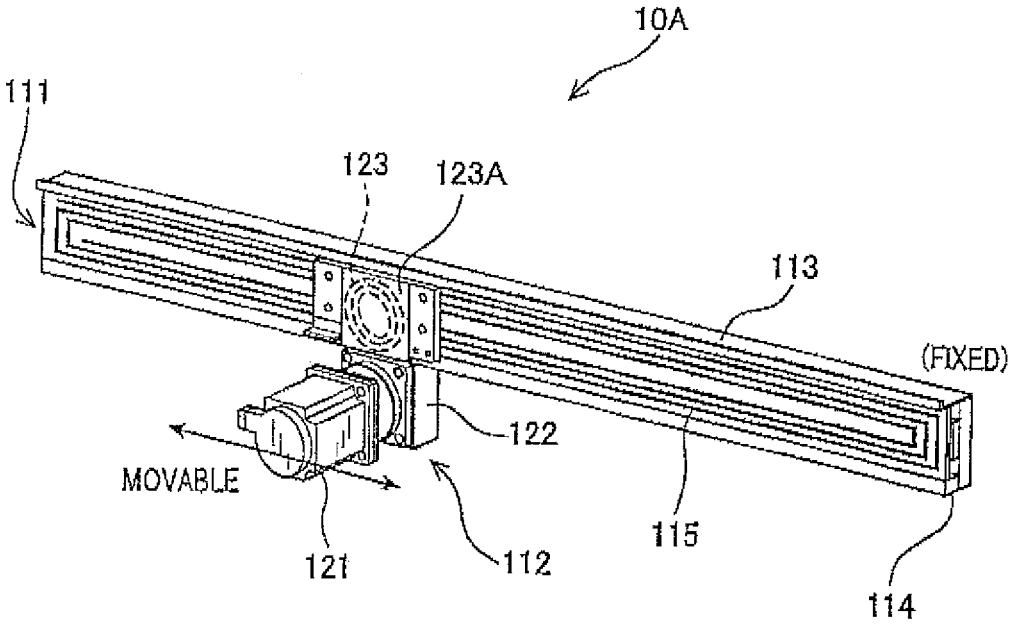
FIG. 8 is a schematic perspective view illustrating a direct drive type robot to which a magnetic resonant coil assembly is applied, according to a second embodiment of the present invention.
Figure 9:
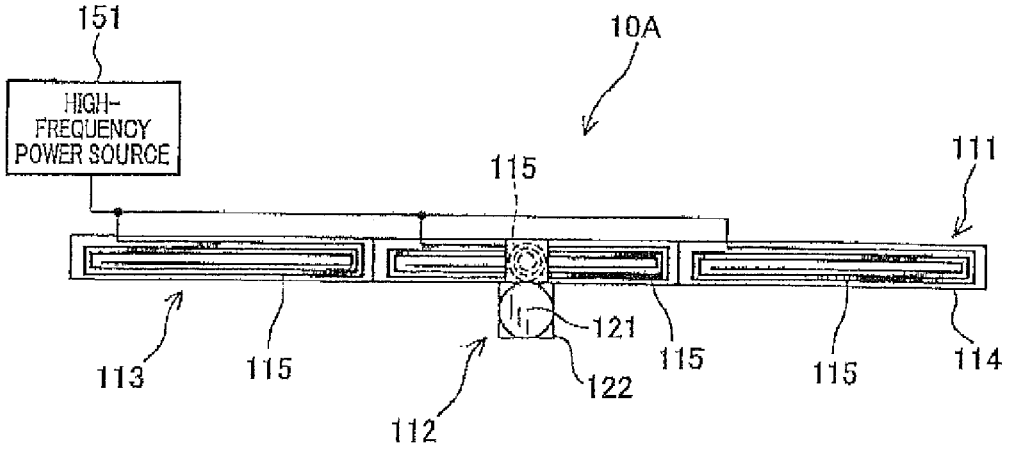
FIG. 9 is a schematic front view illustrating the direct drive type robot to which the magnetic resonant coil assembly is applied, according to the second embodiment.

As shown in FIG. 8, similar to the configuration of the first embodiment, a direct drive type robot 10A (hereinafter also just referred to as "robot 10A") that functions as a direct drive type system (direct drive type machine) includes a fixed unit 111 (functioning as a rail member) on a power transmission side and a movable member 112 on a power reception side. The robot 10A is provided such as in a production facility and a distribution facility. For example, the fixed unit 111 is fixed to a facility at which the robot 10A is set up. The fixed unit 111 includes a rail member 113 that guides the movement of the movable member 112. The rail member 113 is provided along the longitudinal direction of the fixed unit 111. In the present embodiment shown in FIG. 1, the rail member 113 has a lower end provided with a rack 114 (functioning as a holding member). The fixed unit 111 includes a power transmission coil unit 115 along the longitudinal direction of the fixed unit 111. As shown in FIG. 8, the power transmission coil unit 115 is provided as a single segment along the length of the rail member 113, or, as shown in FIG. 9, as a plurality of segments along the length of the rail member 113.

As shown in FIG. 8, the movable member 112 moves along the rail member 113 of the fixed unit 111, being guided by the rail member 113. The movable member 112 includes an electric motor 121, a drive force transmission member 122 (i.e., a moving member) and a power reception coil unit 123. The drive force transmission member 122 includes a pinion, not shown, that is engaged with the rack 114 of the rail member 113. A motor 121 is integrally provided with the movable member 112 and moves along the rail member 113 together with the movable member 112. The motor 121 supplies drive force to the drive force transmission member 122. The drive force of the motor 121 is transmitted to the rack 114 of the rail member 113 via the drive force transmission member 122. Thus, the pinion, which is engaged with the rack 114, of the drive force transmission member 122 is rotated by the drive force of the motor 121, so that the movable member 112 is moved relative to the rail member 113.

The configuration of the robot 10A is not limited to the one in which the drive force of the motor 121 is transmitted to the rack 114 of the rail member 113 via the drive force transmission member 122. For example, the robot 10A may have a configuration in which an annular belt is provided to the rail member 113 and the movable member 112 moves relative to the rail member 113 using the frictional force generated in relation to the belt. Further, the movable member 112 may be formed with a linear motor which is arranged between the movable member 112 and the rail member 113. The power reception coil unit 123 is provided to the movable member 112 and moves along the rail member 113 integrally with the movable member 112, together with the motor 121 and the drive force transmission member 122.

The robot 10A as described above is provided with various functional parts in the movable member 112. For example, in an example shown in FIG. 10, the movable member 112 of the robot 10A has a lifting mechanism 130. For example, the lifting mechanism 130 drives end effectors 132 of a stage 131 in a direction perpendicular to the moving direction of the movable member 112, using the drive force generated by a motive power source, such as a linear motor.

Figure 11:
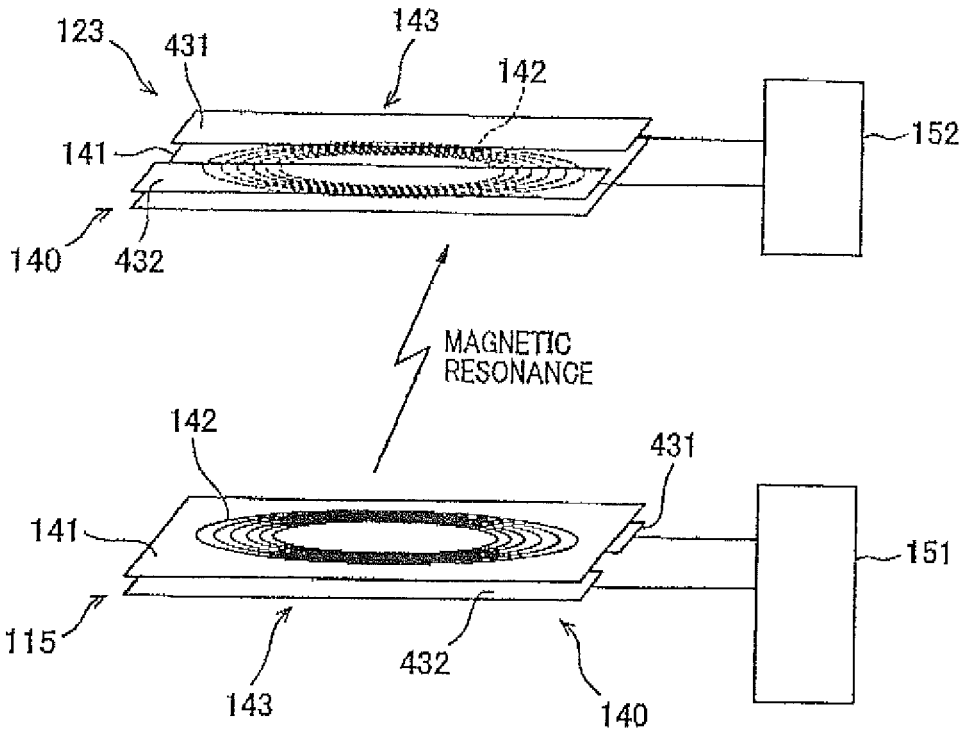
FIG. 11 is a schematic diagram illustrating the magnetic resonant coil assembly, according to the second embodiment.

The present embodiment includes a magnetic resonant coil assembly 140 which functions as a wireless power transmission apparatus. This magnetic resonant coil assembly 140 (hereinafter also just referred to as "coil assembly 140") is provided with the power transmission coil unit 115 and the power reception coil unit 123 in the robot 10A. Specifically, as shown in FIG. 11, the power transmission coil unit 115 on the power transmission side for transmitting electric power, and the power reception coil unit 123 on the power reception side for receiving electric power are each configured by the coil assembly 140.

As shown in FIG. 11 and FIGS. 12 to 14, the power transmission coil unit 115 and the power reception coil unit 123 are each provided with a fiat substrate 141 (i.e., a transmission-side substrate or a reception-side substrate), a coil member 142 (i.e., as a planar coil, a power transmission coil or a power reception coil), and an electrode member 143. The substrate 141 is formed of a well-known material, such as a resin or glass. The coil member 142 is provided to a front surface side that is one surface of the substrate 141. The coil member 142 is a planar coil which is wound planarly on the substrate 141 having a planar shape. The coil member 142 is formed as a printed wiring which is printed on the substrate 141. Not being limited to the printed wiring, the coil member 142 may be provided by pressing or etching a copper sheet into a predetermined coil pattern, or by pasting a copper wire. Further, not being limited to copper, the coil member 142 may be formed of electrically conductive metal, such as aluminum or iron.

Figure 10:
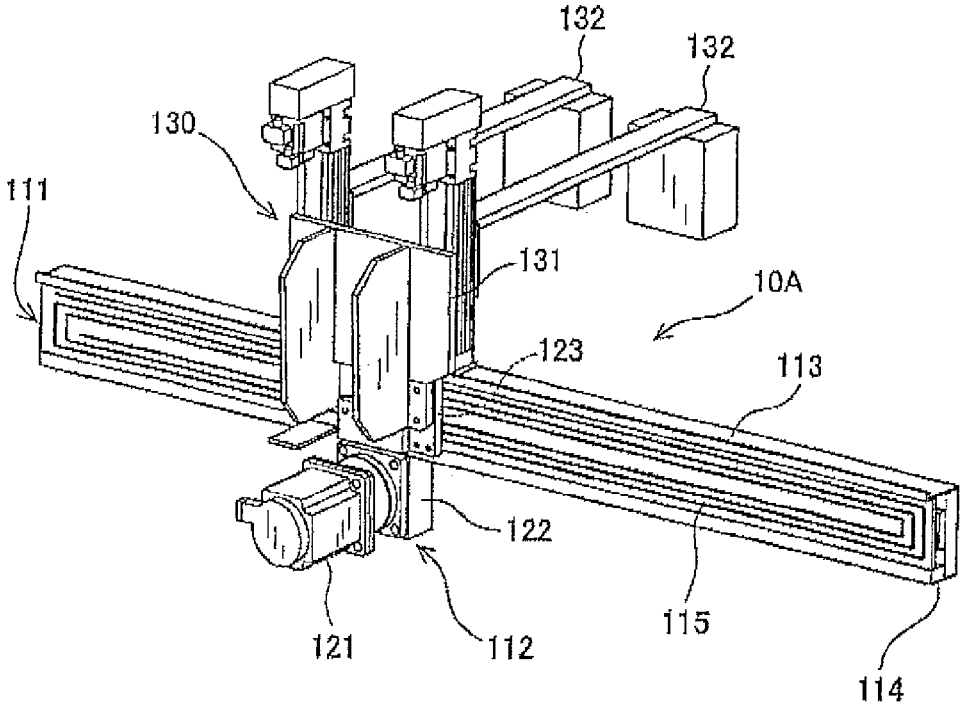
FIG. 10 is a schematic perspective view illustrating the direct drive type robot to which the magnetic resonant coil assembly is applied, according to the second embodiment.

In these drawings, the coil member 142 is pictorially shown as a planar coil wound in a circular form on the substrate 141. Actually however, as shown in FIGS. 8 to 10, the coil member 142 is wound in a rectangular form (an elongated rectangular form) so that the coil member 142 can provide a designated length in its longitudinal direction.

Figure 14:
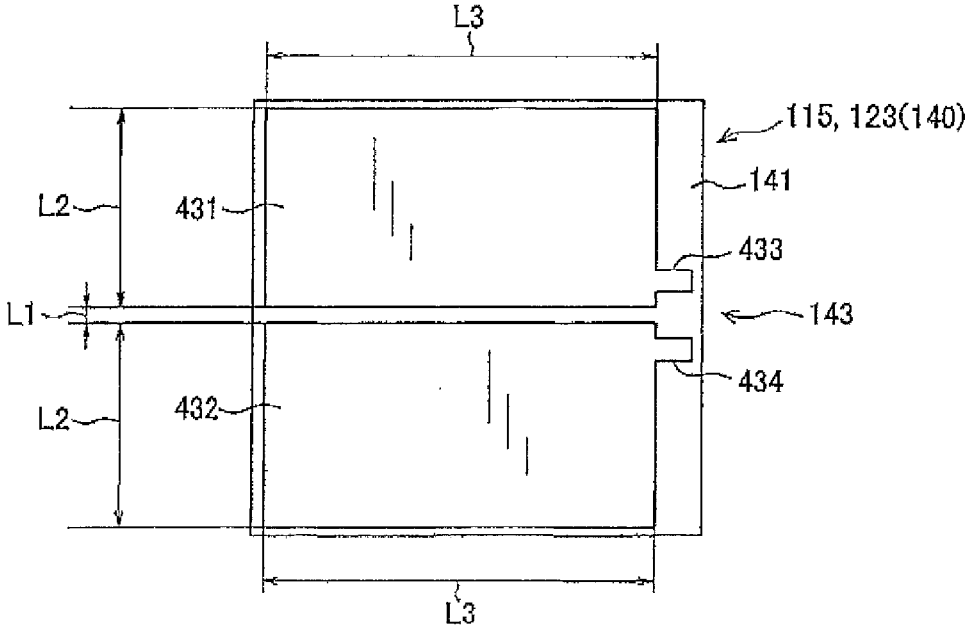
FIG. 14 is a view on arrow as viewed from a direction of an arrow VII of FIG. 13.

The electrode member 143 is formed of plate shaped metal, such as aluminum or iron, having electrical conductivity. The electrode member 143 is provided on a rear surface side of the substrate 141, which is an opposite side of the coil member 142. Thus, the substrate 141, that is a dielectric body, is sandwiched between the electrically conductive coil member 142 and the electrode member 143. As shown in FIG. 14, the electrode member 143 is divided into two, one being an electrode plate 431 and the other being an electrode plate 432. The electrode member 143 does not necessarily have to be divided into two electrical plates 431 and 432 but may be optionally divided into two or more electrode plates. In the present embodiment, the two electrode plates 431 and 432 are separately provided to the substrate 141.

As shown in FIG. 8, the power transmission coil unit 115 is provided to the rail member 113 of the fixed unit 111. In the power transmission coil unit 115, the substrate 141 faces the rail member 113, that is, the substrate 141 is provided in a state where the coil member 142 is exposed to the front side, i.e. exposed to the movable member 112 side. The power reception coil unit 123 is provided to the movable member 11.2. The power reception coil unit 123 is arranged so that the coil member 142 faces the power transmission coil unit 115. The power transmission coil unit 115 and the power reception coil unit 123 are positioned face to face in a non-contact manner with a gap being formed therebetween, the gap having a size ranging from about several millimeters to several tens of millimeters. The power reception coil unit 123 receives electric power from the power transmission coil unit 115 without being in contact therewith, using magnetic resonance that occurs between the power reception coil unit 123 and the power transmission coil unit 115. Specifically, without being in contact with the power transmission coil unit 115, the power reception coil unit 123 receives electric power required for actuating the motor 121 and the stage 131 from the power transmission coil unit 115. Thus, the movable member 112 can dispense with a cable or a cableveyor, irrespective of the length of the fixed unit 111.

Figure 15:
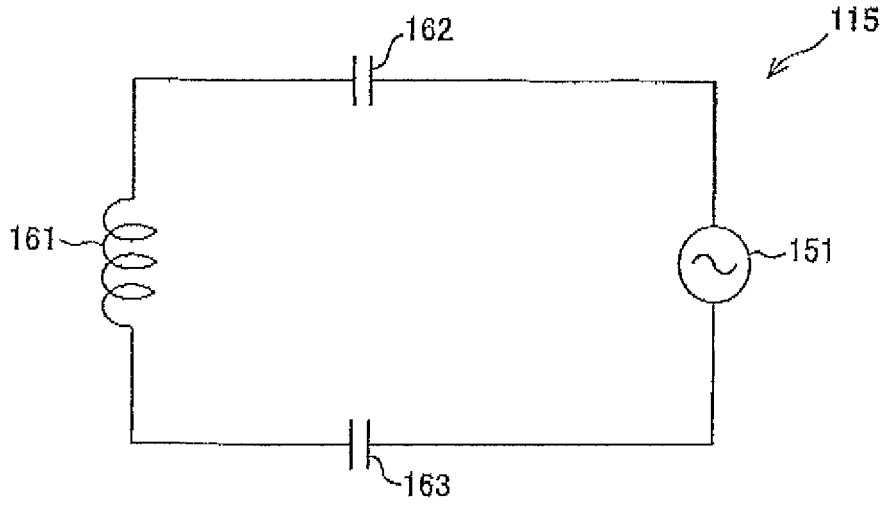
FIG. 15 is a schematic diagram illustrating an electrical circuit of a power transmission coil to which the magnetic resonant coil assembly is applied, according to the second embodiment.
Figure 16:
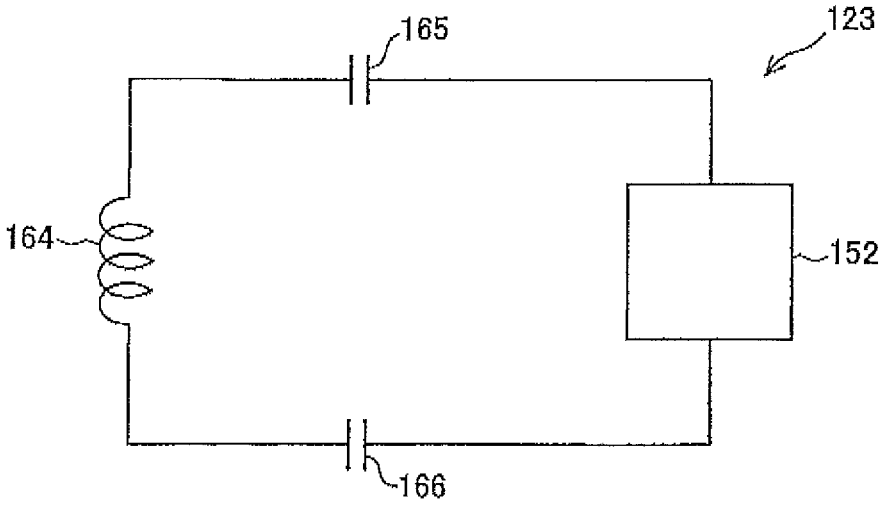
FIG. 16 is a schematic diagram illustrating a configuration of a power reception coil to which the magnetic resonant coil assembly is applied, according to the second embodiment.

As shown in FIG. 11, the power transmission coil unit 115 is connected to a high-frequency power source 151. The electrode plates 431 and 432 are connected to the high-frequency power source 151. The power reception coil unit 123 is connected to a load, such as the motor 121. In the coil assembly 140 configuring the power transmission coil unit 115 and the power reception coil unit 123, an inductor is formed by the coil member 142 and capacitors are formed at portions in which the coil member 142 overlaps with the electrode member 143, with the interposition of the substrate 141. Thus, the power transmission coil unit 115 forms an LC circuit (resonant circuit) as shown in FIG. 15. Specifically, the power transmission coil unit 115 includes an inductor 161 formed by the coil member 142, and includes capacitors 162 and 163 formed between the coil member 142 and the electrode plates 431 and 432, respectively, with the interposition of the substrata 141. Similarly, in the power reception coil unit 123, an LC circuit as shown in FIG. 16 is formed. Specifically, the power reception coil unit 123 includes an inductor 164 formed by the coil member 142, and includes capacitors 165 and 166 formed between the coil member 142 and the electrode plates 431 and 432, respectively, with the interposition of the substrate 141.

Resonance frequency in the magnetic resonance between the power transmission coil unit 115 and the power reception coil unit 123 is influenced by the inductors 161 and 164, and the capacitors 162, 163, 165 and 166 of the LC circuits formed by the coil assemblies 140. Specifically, the resonance frequency varies, depending such as on a thickness t of the substrate 141 shown in FIG. 13, and a distance L1 between the electrode plates 431 and 432 configuring the electrode member 143, a short-side length 12 of the electrode plates 431 and 432 and a long-side length L3 of the electrode plates 431 and 432 shown in FIG. 14. Based on this, FIGS. 17 and 18 show an example of a relationship of resonance frequency to the substrate 141, the coil member 142 and the electrode member 143.

Figure 12:
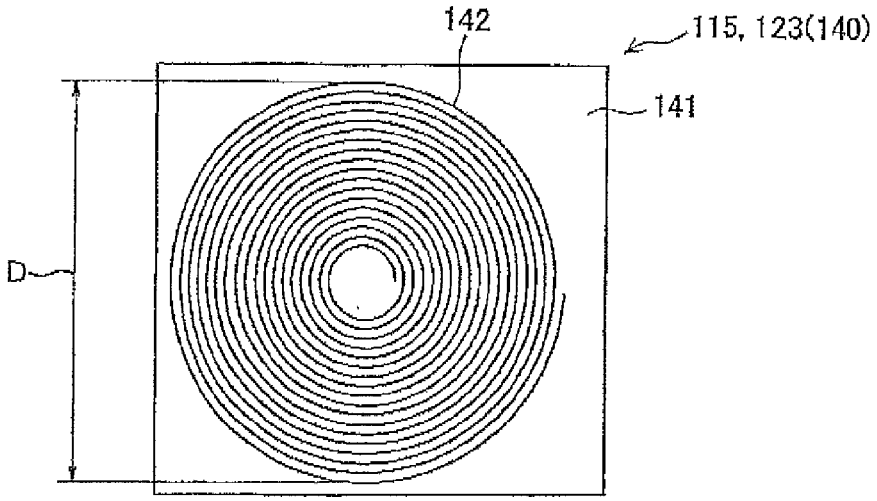
FIG. 12 is a view on arrow as viewed from a direction of an arrow V of FIG. 13.
Figure 13:
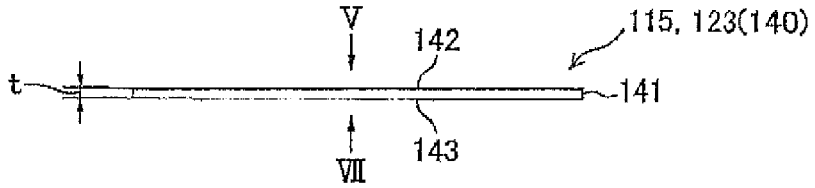
FIG. 13 is a schematic side view illustrating a substrate of the magnetic resonant coil assembly according to the second embodiment.
Figure 17:
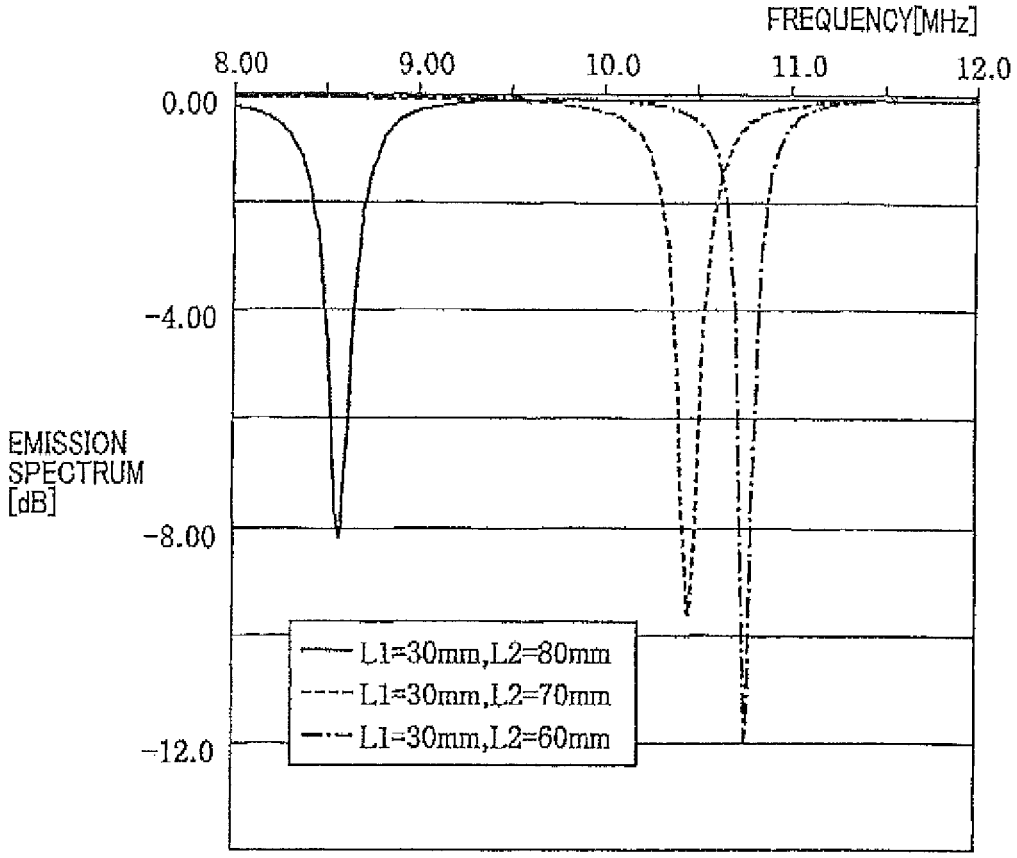
FIG. 17 is a schematic diagram illustrating resonance frequency of the magnetic resonant coil assembly, according to the second embodiment.
Figure 18:
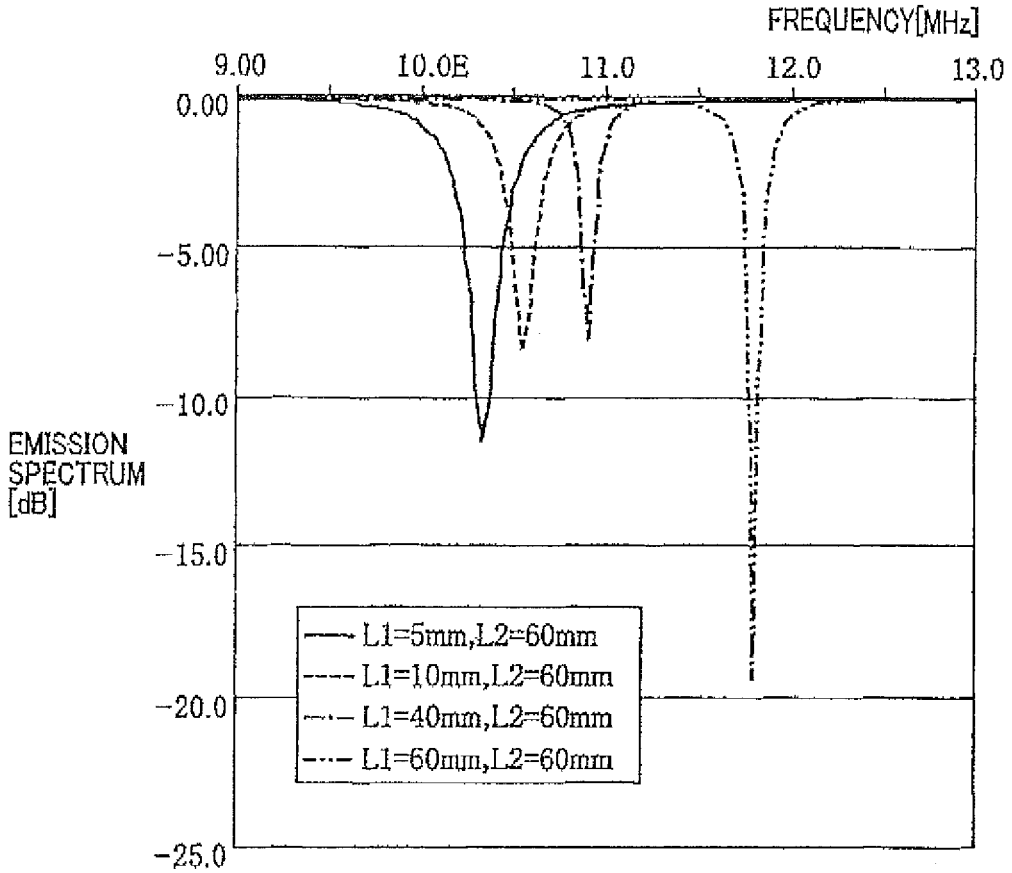
FIG. 18 is a schematic diagram illustrating resonance frequency of the magnetic resonant coil assembly, according to the second embodiment.

In the example shown in FIG. 17, the coil member 142 has a line width d which is set to 2 mm, a diameter D, as shown in FIG. 12, which is set to 150 mm and the number of turns n which is set to 20. In the substrate 141, the thickness t is set to 1.6 mm. Under these conditions, the distance L1 between the electrode plates 431 and 432 is constantly set to 30 mm. Under the conditions set forth above, FIG. 17 shows a relationship of the short-side length L2 of the electrode plates 431 and 432 to resonance frequency. In an example shown in FIG. 18, conditions of the substrate 141 and the coil member 142 are similar to those of the example shown in FIG. 17. Under these conditions, the short-side length L2 of the electrode plates 431 and 432 is constantly set to 60 mm. Under the conditions set forth above, FIG. 18 shows a relationship of the distance L1 between the electrode plates 431 and 432 to resonance frequency.

As will be understood from the description provided-above, in the coil assembly 140, resonance frequency can be easily adjusted by changing the setting thereof, i.e. by changing the distance L1 between the electrode plates 431 and 432, or the short-side length L2 of the electrode plates 431 and 432. In this case, resonance frequency may be adjusted by also changing the thickness t of the substrate 141, the long-side length L3 of the electrode plates 431 and 432, as well as the line width d, the diameter D and the number of turns n of the coil member 142, and the like.

Hereinafter is described transmission of electric power in the direct drive type robot WA described above.

As shown in FIG. 11, the high-frequency power source 151 connected to the power transmission coil unit 115 supplies high-frequency alternating current ranging from several MHz to several tens of MHz to the power transmission coil unit 115 to establish magnetic resonance. For example, the high frequency is set to an optionally selected value for establishing magnetic resonance, depending such as on the characteristics of the power transmission coil unit 115 and the power reception coil unit 123. When electric power is fed to the power transmission coil unit 115 from the high-frequency power source 151, magnetic resonance occurs in a portion in which the power transmission coil unit 115 and the power reception coil unit 123 face with each other. Accordingly, the power reception coil unit 123 receives electric power from the power transmission coil unit 115 based on the magnetic resonance. On the other hand, when electric power is fed to the power transmission coil unit 115 but the power transmission coil unit 115 and the power reception coil unit 123 are not positioned face to face, unnecessary electric field and magnetic field are not emitted from the power transmission coil unit 115. Specifically, when electric power is fed to the power transmission coil unit 115, at a portion in which the power transmission coil unit 115 and the power reception coil unit 123 are in a face-to-face relation, transmission and reception of electric power is performed using the magnetic resonance. In contrast, at a portion in which the power transmission coil unit 115 and the power reception coil unit 123 are not in a face-to-face relation, the transmission and reception of electric power is not performed, and the emission of electric field and magnetic field hardly occurs. The reasons for this are similar to the ones described in the first embodiment. Thus, emission of unnecessary electric field and magnetic file is reduced and thus emission of electromagnetic noises accompanying this is reduced.

As described above, in the present embodiment, the electric power needed by the movable member 112 is fed in a non-contact manner based on the magnetic resonance established between the power transmission coil unit 115 and the power reception coil unit 123. Thus, the basic advantageous effects similar to those of the first embodiment can be enjoyed.

In the present embodiment, the plate-like electrode member 143 is provided on a rear surface side which is an opposite side of the coil member 142, with the interposition of the substrate 141. Thus, with the substrate 141 being sandwiched between the coil member 142 and the electrode member 143, the capacitors 162, 163, 165 and 166 are formed. Further, the coil member 142 provided to the substrate 141 forms a reactance. Formation of these capacitors 162, 163, 165 and 166 and the reactance induces resonance. Thus, the resonance frequency is adjusted by changing the overlap conditions, such as the size, shape and arrangement of the electrode member 143, the thickness of the substrate 141, and the like, between the electrode member 143 and the coil member 142. Accordingly, the resonance frequency can be easily adjusted without causing increase in the size of parts, complication of processing steps and reduction in the Q value of resonance.

(Other Embodiments)

Figure 19:
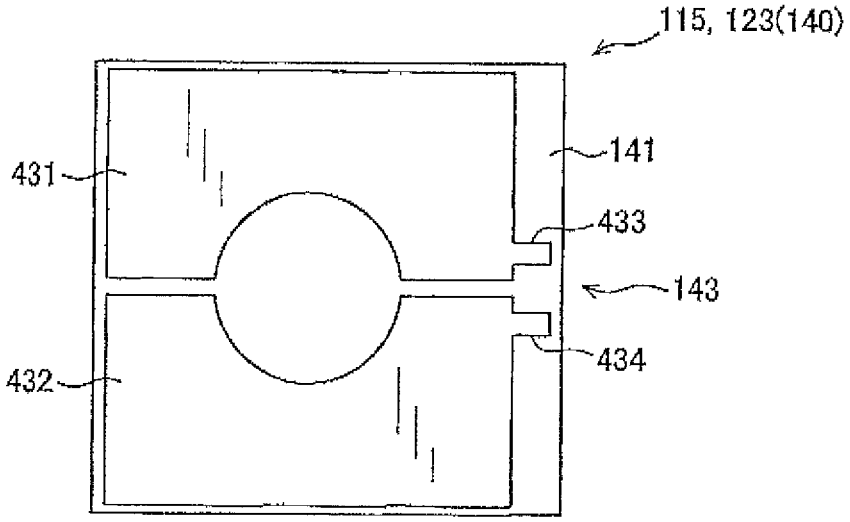
FIG. 19 is a diagram corresponding to FIG. 7, illustrating the magnetic resonant coil assembly, according to a modification of the second embodiment.
Figure 20:
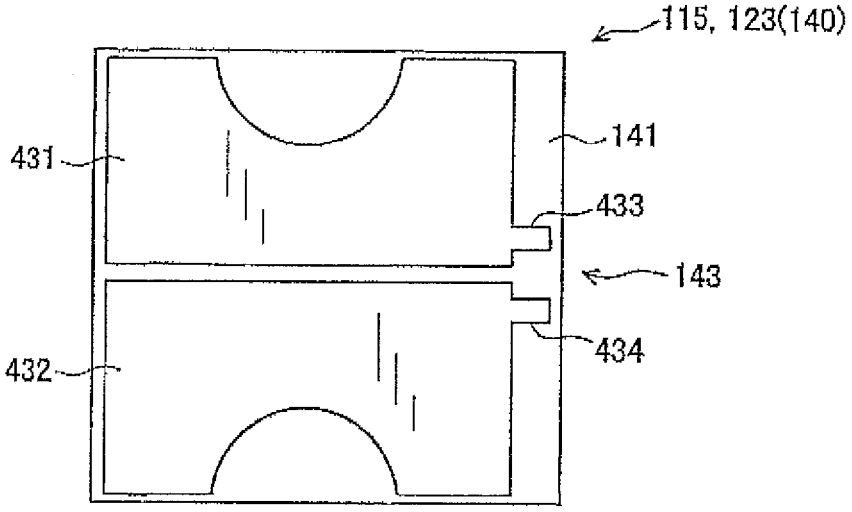
FIG. 20 is a diagram corresponding to FIG. 7, illustrating the magnetic resonant coil assembly, according to another modification of the second embodiment.

FIGS. 19 and 20 each show an electrode member of a field magnetic resonance coil member according to other embodiments.

As shown in these figures, in the coil assembly 140, the shape of the electrode member 143 can be changed. The electrode member 143 of the coil assembly 140 can be changed not only in its shape but also in the number of the electrode plates if only the number is two or more. Thus, change in the shape of the electrode member 143 of the coil assembly 140 leads to the change in the capacity of the capacitors formed between the electrode member 143 and the coil member 142, with the interposition of the substrate 141. In this way, the range of adjusting resonance frequency is expanded.

The present invention described so far is not limited to the embodiments described above but may be applied to various embodiments within a scope not departing from the spirit of the invention. For example, the shape and the number of turns of the coil member 142 may be optionally change.

[Third Embodiment]

Referring to FIGS. 21 to 28, hereinafter is described a third embodiment of a wireless power transmission apparatus and a direct drive type system including the apparatus.

Figure 21:
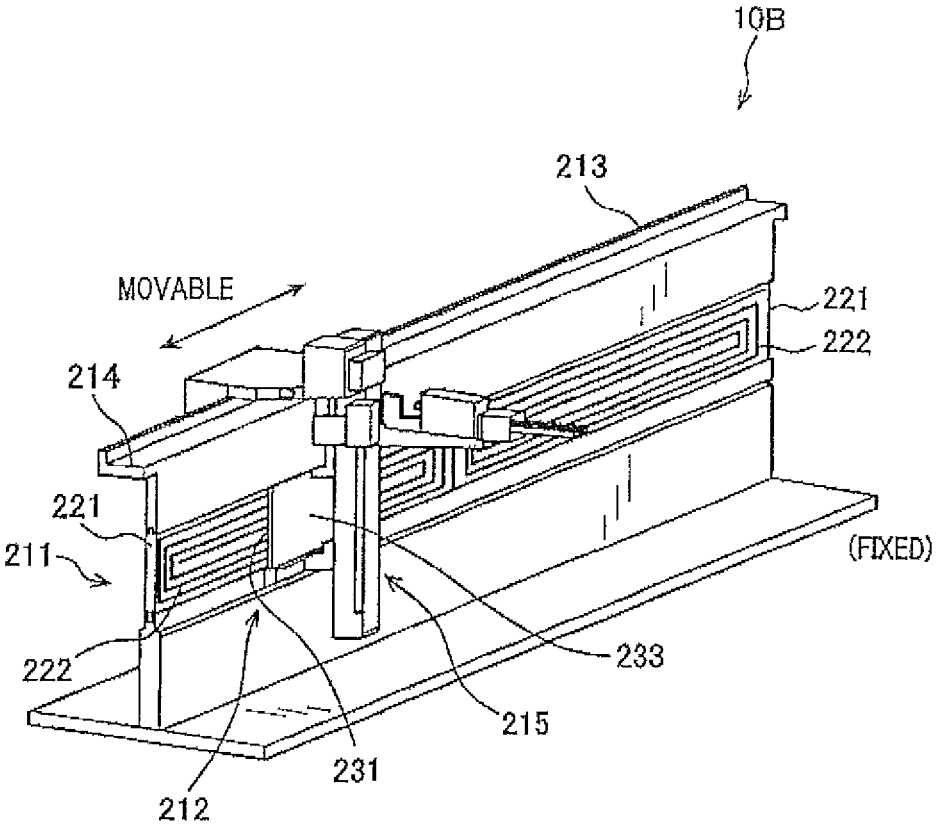
FIG. 21 is a schematic perspective view illustrating a direct drive type robot, according to a third embodiment of the present invention.
Figure 22:
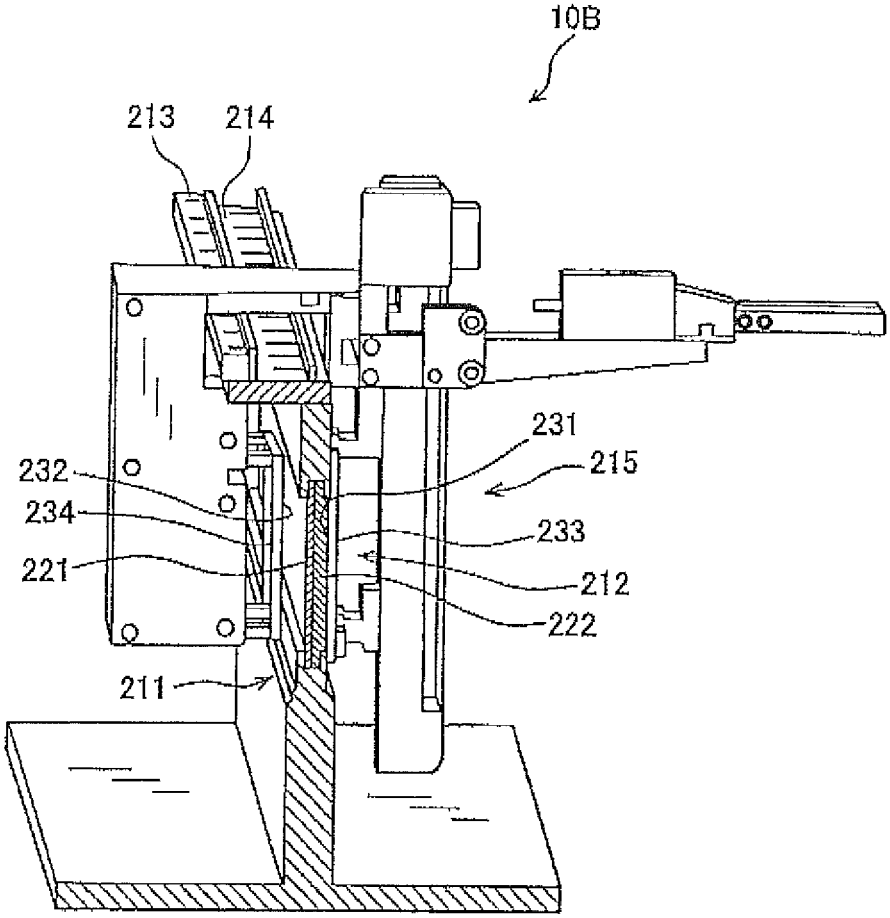
FIG. 22 is a schematic perspective view illustrating the direct drive type robot, according to the third embodiment.
Figure 23:
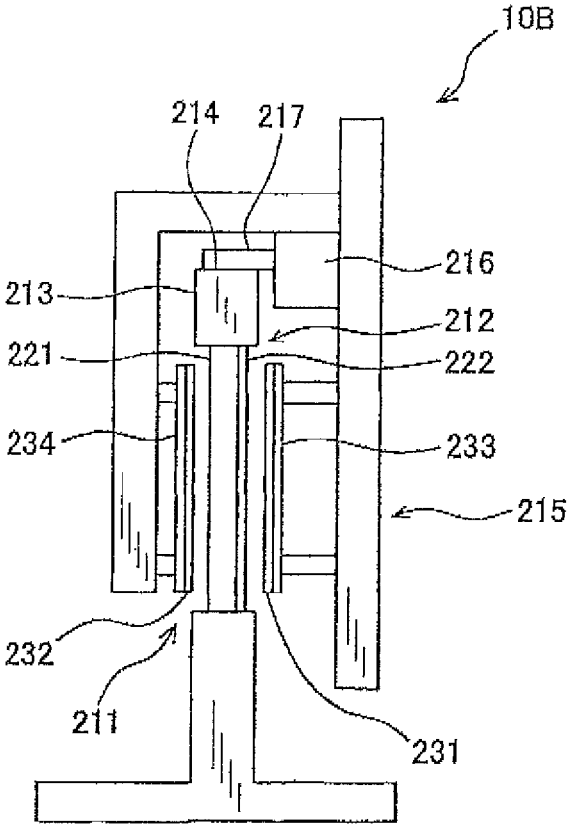
FIG. 23 is a schematic diagram illustrating a configuration of the direct drive type robot according to the third embodiment.

As shown in FIGS. 21 to 23, a direct drive type robot 10B (hereinafter also just referred to as "robot 108") includes a power transmission coil unit 211 (functioning as a rail member) and a power reception coil unit 212. The power transmission coil unit 211 and the power reception coil unit 212 configure the wireless power transmission apparatus. The robot 108 is set up in a production facility, a distribution facility and the like. The power transmission coil unit 211 includes a rail 213 in which a rack, not shown, is formed. The rail 213 is provided along the longitudinal direction of the power transmission coil unit 211. In the embodiment shown in FIGS. 21 to 23, the rail 213 has an upper end which is provided with a rack 214 functioning as a holding member.

The robot 10B includes a movable member 215 which moves along the rail 213 of the power transmission coil unit 211, being guided by the rail 213. As shown in FIG. 23, the movable member 215 includes an electric motor 216 and a drive force transmission member 217 (i.e., a moving member). The movable member 215 is integrally provided with the power reception coil unit 212. The motor 216 is integrally provided with the movable member 215 and moves along the rail 213 together with the movable member 215. The motor 216 supplies drive force to the drive force transmission member 217. The drive force transmission member 217 includes a pinion, not shown, that is engaged with the rack 214 of the rail 213. The drive force of the motor 216 is transmitted to the rack of the rail 213 via the drive force transmission member 217. Thus, the pinion, which is engaged with the rack, of the drive force transmission member 217 is rotated by the drive force of the motor 216, while the movable member 215 is permitted to move relative to the rail 213. The configuration of the robot 108 is not limited to the one in which the drive force of the motor 216 is transmitted to the rack 214 of the rail 213 via the drive force transmission member 217. For example, the robot 108 may have a configuration in which an annular belt is provided to the rail 213 and the movable member 215 moves relative to the rail 213 using the frictional force generated in relation to the belt. Further, the movable member 215 may be formed with a linear motor which is arranged between the movable member 215 and the rail 213.

Figure 24:
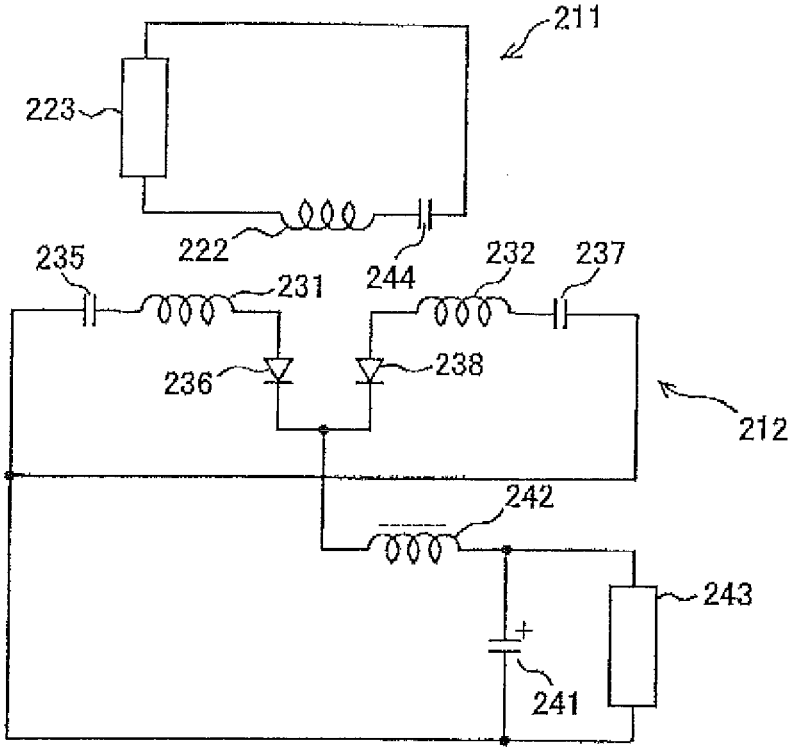
FIG. 24 is a schematic diagram illustrating an electrical circuit configuration of the direct drive type robot, according to the third embodiment.

As shown in FIGS. 21 to 23, the power transmission coil unit 211 includes a substrate 221 and a planar power transmission coil 222. The power transmission coil 222 is planarly wound on a surface of the substrate 221. In the embodiment shown in FIG. 21, the power transmission coil unit 211 includes the power transmission coil 222 having a plurality of windings. The power transmission coil unit 211 may include a power transmission coil 222 having a single winding. As shown in FIG. 24, the power transmission coil 222 is connected to a power supply member 223. Thus, electric power is fed to the power transmission coil 222 from the power supply member. For example, the power transmission coil 222 is formed of a copper plate punched into a predetermined pattern, a pasted copper wire, or a printed wiring.

As shown in FIGS. 21 to 23, the power reception coil unit 212 is integrally formed with the movable member 215 and integrally moves with the movable member 215 along the rail 213, together with the motor 216 and the drive force transmission member 217. As shown in FIGS. 22 and 23, the power reception coil unit 212 includes, as a power reception coil, a first coil 231 (i.e., a frontal reception coil serving as the power reception coil) and a second coil 232 (i.e., a rear reception coil serving as the power reception coil). The first coil 231 is provided to a first substrate 233 (i.e., a frontal substrate serving as a reception-side substrate). Specifically, the first coil 231 is provided to a surface of the first substrate 233, the surface being on the power transmission coil unit 211 side. Thus, the first coil 231 faces the front surface of the substrate 221 of the power transmission coil unit 211, i.e. faces the power transmission coil 222 provided to the substrate 221. The second coil 232 is provided to a second substrate 234 (i.e., a rear substrate serving as the reception-side substrate). Specifically, the second coil 232 is provided to a surface of the second substrate 234, the surface being on the power transmission coil unit 211 side. Thus, the second coil 232 faces the rear surface of the substrate 221 of the power transmission coil unit 211, i.e. faces a surface of the substrate 221, the surface being not provided with the power transmission coil 222.

With this configuration, in the power reception coil unit 212, the first coil 231 faces the front surface of the substrate 221, while the second coil 232 faces the rear surface of the substrate 221, with the interposition of the substrate 221 of the power transmission coil unit 211. As a result, the power transmission coil unit 211 is sandwiched between the first and second coils 231 and 232. Similar to the power transmission coil 222, the first and second coils 231 and 232 are each formed of a copper plate, a copper wire or a printed wiring.

Figure 25:
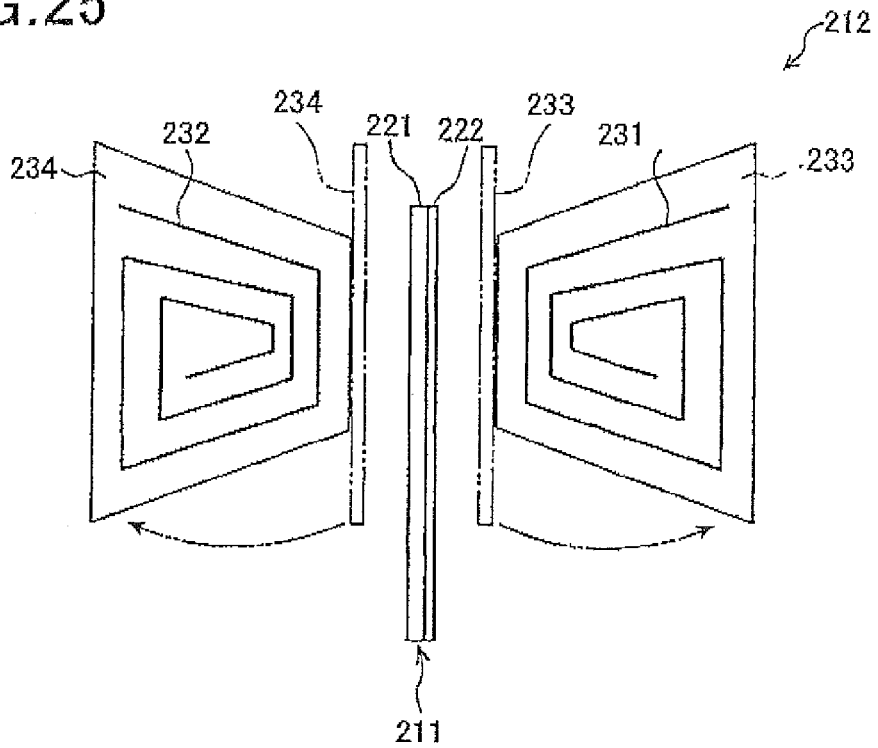
FIG. 25 is a schematic diagram illustrating a power reception coil unit of the direct drive type robot, according to the third embodiment.

The first and second coils 231 and 232 are both planar coils. As shown in FIG. 25, the first and second coils 231 and 232 are wound in respective directions so as to be related as mirror image, sandwiching the substrate 221 that is provided with the power transmission coil 222. In other words, the first and second coils 231 and 232 have reverse winding directions. A gap ranging from several millimeters to several tens of millimeters is formed between the first coil 231 and the front surface of the substrate 221, which is provided with the power transmission coil 222, and between the second coil 232 and the rear surface of the substrate 221, so as to be non-contact with each other. Electric power Is transmitted in between the power transmission coil 222, the first coil 231 and the second coil 232, making use of magnetic resonance, with these coils not being in contact with each other. Specifically, the first and second coils 231 and 232 receive electric power to be consumed such as by the motor 215 from the power transmission coil 222, without being in contact with the power transmission coil 222. The movable member 215 receives electric power from the power transmission coil 222 in a non-contact manner via the first and second coils 231 and 232. Accordingly, when the length of the rail 213 is optionally extended, neither a cable nor a cable carrier is needed for the transmission of electric power to the movable member 215.

As shown in FIG. 24, the first coil 231 configures an LC circuit together with a resonance capacitor 235. The first coil 231 is serially inserted with a diode 236 on a side opposite to the resonance capacitor 235. Similarly, the second coil 232 configures an LC circuit together with a resonance capacitor 237. The second coil 232 is serially inserted with a diode 23B on a side opposite to the resonance capacitor 237. The first and second coils 231 and 232 are connected to a smoothing capacitor 241 and a smoothing choke coil 242, respectively. A load 243, such as the motor 216, in the movable member 215 is parallelly connected to the smoothing capacitor 241. In the circuit on the movable member 215 side, not being limited to the smoothing capacitor 241 and the smoothing choke coil 242, a rectifier circuit may be connected. On the other hand, the power transmission coil 222 of the power transmission coil unit 211 configures an LC circuit together with a resonance capacitor 244 and is connected to the power supply member 223. The power supply member 223 supplies high-frequency alternating current ranging from several MHz to several tens of MHz to the power transmission coil 222.

The robot 10B is provided with various functional parts in the movable member 215, such as a lifting mechanism, not shown. For example, the lifting mechanism uses the drive force generated by the motive power source, such as a linear motor, to drive a stage, not shown, in a direction perpendicular to the moving direction of the movable member 215. In this case, similar to the motor 216 of the movable member 215, the electric power needed for the activation of the functional part is fed through non-contact power transmission performed between the power transmission coil 222, the first coil 231 and the second coil 232.

Hereinafter is described transmission of electric power in the direct drive type robot 10B described above.

The power supply member 223 passes high-frequency alternating current ranging from several MHz to several tens of MHz to the power transmission coil 222 to establish magnetic resonance. For example, the high frequency supplied by the power supply member 223 is set to an optionally selected value for establishing magnetic resonance, depending such as on the characteristics of the power transmission coil 222, and the first and second coils 231 and 232 of the power reception coil unit 212. When the power source is turned on, the power supply member 223 applies high frequency to the power transmission coil 222. Thus, when high frequency is applied to the power transmission coil 222, magnetic resonance occurs at a portion in which the power transmission coil 222 faces the first and second coils 231 and 232 of the power reception coil unit 212. Accordingly, the power reception coil unit 212 receives electric power from the power transmission coil 222, using the magnetic resonance. On the other hand, when high frequency is applied to the power transmission coil 222, unnecessary electric field and magnetic field are not emitted from the power transmission coil 222 at a portion in which the power transmission coil 222 does not face the power reception coil unit 212 Specifically, when current is passed to the power transmission coil 222, transmission and reception of electric power is performed using the magnetic resonance at a portion in which the power transmission coil 222 faces the power reception coil unit 212. In contrast, at a portion in which the power transmission coil 222 does not face the power reception coil unit 212, transmission and reception of electric power is not performed, and thus electric field and magnetic field are hardly emitted.

The reasons for this are similar to those based on impedance. Specifically, when the first and second coils 231 and 232 of the power reception coil unit 212 do not face the power transmission coil 222, application of high frequency to the power transmission coil 222 drastically increases the impedance of the power transmission coil 222 at resonance frequency based on the magnetic resonance. Accordingly, at a portion in which the power transmission coil 222 does not face the first and second coils 231 and 232 of the power reception coil unit 212 and thus no magnetic resonance occurs, application of high frequency to the power transmission coil 222 hardly causes current flow and thus emission of electric field and magnetic field hardly occurs. In contrast, when the first and second coils 231 and 232 of the power reception coil unit 212 face the power transmission coil 222, impedance of the power transmission coil 222 is reduced at resonance frequency based on the magnetic resonance. Thus, similar to the above, emission of unnecessary electric field and magnetic field is reduced and thus emission of electromagnetic noises accompanying this is reduced.

Hereinafter is described the effects of the direct driven type robot 10B.

Figure 26:
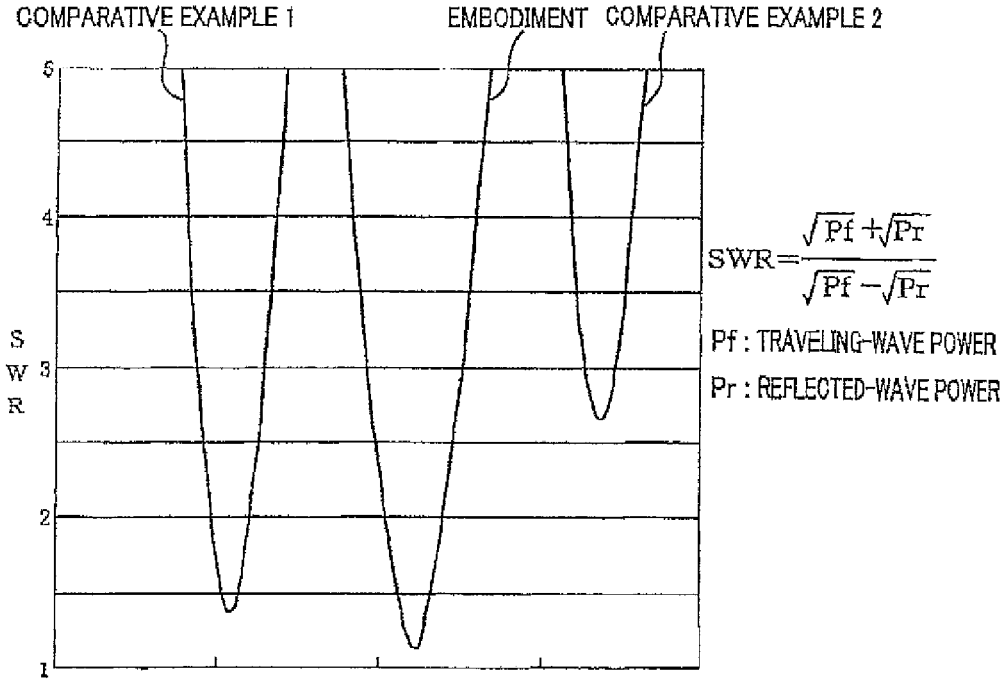
FIG. 26 is a schematic diagram illustrating a relationship between a configuration of the power reception coil unit and SWR.

FIG. 26 shows a relationship between the configuration of the power reception coil unit 212 and SWR (standing wave ratio). SWR is calculated from the following Formula (1):

$$SWR=\{(Pf)^{1/2}+(Pr)^{1/2}\}/\{(Pr)^{1/2}+(Pf)^{1/2}\} \quad (1)$$

wherein Pf is a traveling-wave power and Pr is a reflected-wave power.

A relation SWR=1 refers to that reflected wave is "0". When reflected wave is "0", it means that the electric power outputted from the power transmission coil 222 has all been transmitted to the power reception coil unit 212. Accordingly, when SWR=1, transmission efficiency from the power transmission coil 222 to the power reception coil unit 212 is 100%.

Figure 27:
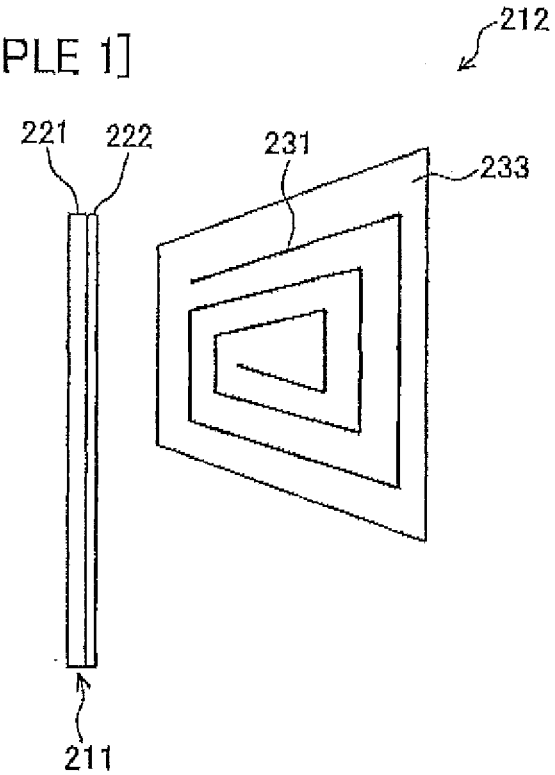
FIG. 27 is a schematic diagram illustrating a power reception coil unit of a direct drive type robot, according to Comparative Example 1.
Figure 28:
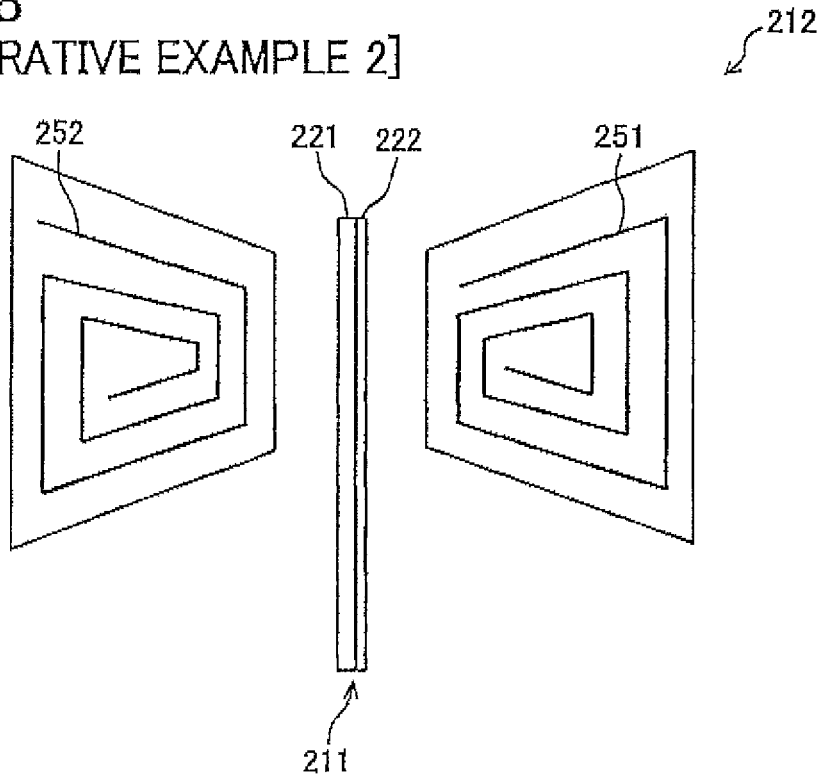
FIG. 28 is a schematic diagram illustrating a power reception coil unit of a direct drive type robot, according to Comparative Example 2.

As shown in FIGS. 23 and 25, in the embodiment, the power reception coil unit 212 includes the first and second coils 231 and 232 that sandwich the power transmission coil unit 211. As shown in FIG. 27, in Comparative Example 1, the power reception coil unit 212 includes only the first coil 231 that faces the power transmission coil 222. As shown in FIG. 28, in Comparative Example 2, the power reception coil unit 212 includes two coils 251 and 252 that sandwich the power transmission coil unit 211 similar to the embodiment. However, as shown in FIG. 28, in the power reception coil unit 212 of Comparative Example 2, the two coils 251 and 252 are wound in respective directions that do not establish a mirror-image relationship.

As can be seen from FIG. 26, in the power reception coil unit 212 of the embodiment, SWR is approximate to "1", i.e. reflectance is large, compared to Comparative Examples and 2. Specifically, in the power reception coil unit 212 of the embodiment, reflectance is 0.2%. In other words, in the power reception coil unit 212 of the embodiment, transmission efficiency is 99.8%. In contrast, reflectance in Comparative Example 1 is 5.0% and that in Comparative Example 2 is 20%. As will be understood from these numerical data, the power reception coil unit 212 having the configuration of the present embodiment enhances transmission efficiency.

In the embodiment, the second coil 232 of the power reception coil unit 212 is opposed to the rear surface of the substrate 221 of the power transmission coil unit 211. A greater part of electric power transmission via the magnetic resonance that occurs between the power transmission coil unit 211 and the power reception coil unit 212 is performed between the power transmission coil 222 and the first coil 231. In this case, the magnetic flux caused by the magnetic resonance between the power transmission coil 222 and the first coil 231 leaks toward the rear surface of the substrate 221 that mounts the power transmission coil 222. The leaked magnetic flux induces noises. However, in the embodiment, the second coil 232 faces the rear surface of the substrate 221. Accordingly, the magnetic flux that has leaked toward the rear surface of the substrate 221 is shielded by the second coil 232. At the same time, the magnetic flux that has leaked toward the rear surface of the substrate 221 causes magnetic resonance between the power transmission coil 222 and the second coil 232. Thus, the electric power outputted from the power transmission coil 222 is transmitted not only to the first coil 231 but also to the second coil 232. As a result, the noises accompanying the magnetic flux leakage is reduced and at the same time transmission efficiency is enhanced between the power transmission coil unit 211 and power reception coil unit 212.

Further, in the case where the power transmission coil unit 211 is sandwiched between the first and second coils 231 and 232, the direction of winding the first and second coils 231 and 232 exerts an influence on transmission efficiency. As can also be seen from FIG. 26, the embodiment, in which the first and second coils 231 and 232 are wound in respective directions so as to establish a mirror-image relationship therebetween, exhibits higher transmission efficiency compared to Comparative Example 2. Thus, in the case where the power transmission coil unit 211 is sandwiched between the first and second coils 231 and 232, it is desired that the first and second coils 231 and 232 are wound in respective directions so as to establish a mirror-image relationship therebetween.

As described above, the electric power needed by the movable member 215 is fed in a non-contact manner via the magnetic resonance that occurs between the power transmission coil unit 211 and the power reception coil unit 212. Thus, the basic advantageous effects of the first embodiment described above can be enjoyed.

In the embodiment, when electric power is fed from the power transmission coil unit 211 to the power reception coil unit 212, a greater part of the magnetic resonance occurs between the power transmission coil 222 and the first coil 231. In this case, the magnetic flux caused between the power transmission coil 222 and the first coil 231 via the magnetic resonance begins to leak toward the rear surface of the substrate 221. Since the rear surface of the substrate 221 is opposed to the second coil 232, the leaked magnetic flux is shielded by the second coil 232, while causing magnetic resonance between the power transmission coil 222 and the second coil 232 as well. Accordingly, the emission of noises induced by the magnetic flux leakage is reduced and at the same time the efficiency of transmitting electric power via the magnetic resonance can be enhanced.

Further, the first and second coils 231 and 232 are planar coils and have shapes of establishing a mirror-image relationship therebetween, with the interposition of the substrate 221. Thus, by forming the first and second coils 231 and 232 so as to establish a mirror-image relationship therebetween, reflectance is reduced between the power transmission coil unit 231 and the power reception coil unit 212. In other words, the efficiency is enhanced in transmitting the electric power from the power transmission coil unit 211 to the power reception coil unit 212. Thus, transmission efficiency of electric power via the magnetic resonance is more enhanced.

[Fourth Embodiment]

Referring now to FIGS. 29 to 34, hereinafter is described a fourth embodiment of a wireless power transmission apparatus and a direct drive type system including the apparatus.

Figure 29:
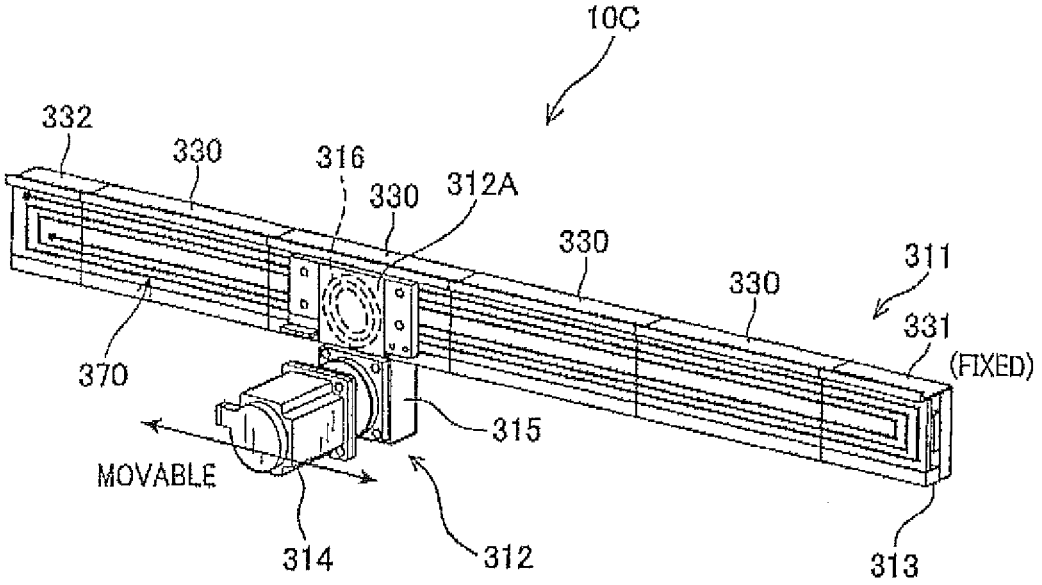
FIG. 29 is a schematic perspective view illustrating a direct drive type robot to which a power transmission coil assembly is applied, according to a fourth embodiment of the present invention.

FIG. 29 shows a direct drive type robot 10C (hereinafter also just referred to as "robot 10C") as a direct drive type system. The robot 10C includes a power transmission coil assembly 311 and a movable member 312 and serves as a wireless power trans mission apparatus. The robot 10C is set up such as in a production facility and a distribution facility. For example, the power transmission coil assembly 311 is fixed to a facility in which the robot 10C: is set up. The power transmission coil assembly 311 includes a rail member 313 in which a rack (i.e., a holding member), not shown, is formed. The rail member 313 is provided along the longitudinal direction of the power transmission coil assembly 311. In the fourth embodiment shown in FIG. 29, the rail member 313 has a lower end to which the rack is provided.

The movable member 312 moves along the rail member 313 of the power transmission coil assembly 311, while being guided by the rail member 313. The movable member 312 includes an electric motor 314, a drive force transmission member 315 (provided as a moving member) and a power reception coil 316. The drive force transmission member 315 includes a pinion, not shown, that is engaged with the rack of the rail member 313. The motor 314 is integrally provided with the movable member 312 and moves along the rail member 313 together with the movable member 312. The motor 314 supplies drive force to the drive force transmission member 315. The drive force of the motor 314 is transmitted to the rack of the rail member 313 via the drive force transmission member 315. Thus, the pinion, which is engaged with the rack, of the drive force transmission member 315 is rotated by the drive force of the motor 314 and the movable member 312 moves relative to the rail member 313.

The configuration of the robot 10C is not limited to the one in which the drive force of the motor 314 is transmitted to the rack of the rail member 313 via the drive force transmission member 315. For example, the robot 10C may have a configuration in which an annular belt is provided to the rail member 313 and the movable member 312 moves relative to the rail member 313 using the frictional force generated in relation to the belt. Further, the movable member 312 may be formed with a linear motor which is arranged between the movable member 312 and the rail member 313.

The power reception coil 316 is provided on a substrate 312A (a reception-side substrate) arranged to the movable member 312 and moves integrally with the movable member 312 along the rail member 313 together with the motor 314 and the drive force transmission member 315. The power reception coil 316 faces the power transmission coil assembly 311. The power reception coil 315 is formed of a planar coil which is planarly wound on a plate-like substrate. The power reception coil 316 faces the power transmission coil assembly 311 in a non-contact manner, forming a gap therebetween that ranges from about several millimeters to several tens of millimeters. The power reception coil 316 receives electric power from the power transmission coil assembly 311 without being in contact therewith, due to a magnetic resonance that occurs between the power reception coil 316 and the power transmission coil assembly 311. In other words, the power reception coil 316 receives electric power to be consumed such as by the motor 314 from the power transmission coil assembly 311 without being in contact therewith. Accordingly, the movable member 312 can dispense with a cable and a cable carrier, irrespective of the length of the power transmission coil assembly 311.

The robot 10C is provided with various functional parts in the movable member 312. For example, in an example shown in FIG. 30, the robot 10C includes a lifting mechanism 320. For example, the lifting mechanism 320 drives end effectors 322 of a stage 321 in a direction perpendicular to the moving direction of the movable member 312, using the drive force generated by a motive power source, such as a linear motor. In this case, similar to the motor 314, the electric power needed for the actuation of the motive power source is obtained through non-contact power transmission performed between the power transmission coil assembly 311 and the power reception coil 316.

Hereinafter is described the power transmission coil assembly 311.

Figure 31:
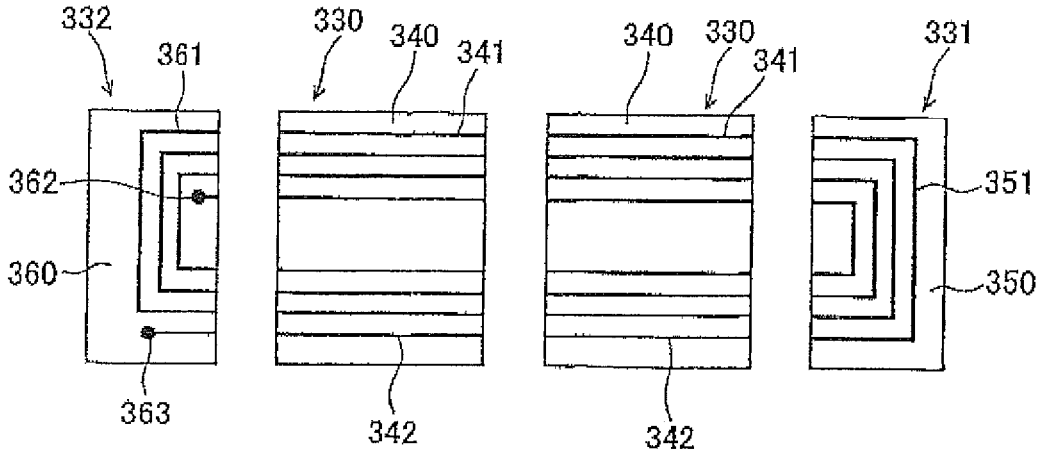
FIG. 31 is a schematic exploded view illustrating the power transmission coil assembly, according to the fourth embodiment.

In the fourth embodiment, as shown in FIGS. 29 and 31, the power transmission coil assembly 311 includes a plurality of intermediate coil units 330, a first-end coil unit 331 and a second-end coil unit 332. As shown in FIG. 31, the intermediate coil unit 330 includes a first coil wiring part 341 and a second coil wiring part 342, which are provided to a substrate 340 (that is, intermediate substrates serving as part of a transmission-side substrate). The first and second coil wiring parts 341 and 342, which act as intermediate transmission coil portions which are part of the power transmission coil, are provided parallel to each other along the longitudinal direction of the power transmission coil assembly 311. In the example shown in FIG. 31, the first coil wiring part 341 is provided on an upper end side of the substrate 340 and the second coil wiring part 342 is provided on a lower end side of the substrate 340. As mentioned above, the first coil wiring parts 341 is arranged parallel to the second coil wiring parts 342. As shown by solid lines in FIG. 31, the first coil wiring part 341, as well as the second coil wiring part 342, is configured by a plurality of wiring members parallel to each other. For example, the wiring members configuring the first and second coil wiring parts 341 and 342 are formed by etching or pressing a copper sheet, or pasting a copper wire, or formed of a printed wiring.

Figure 32:
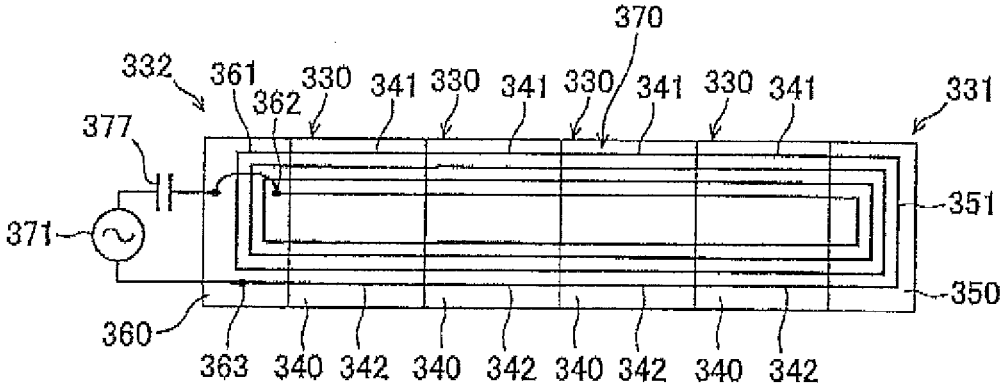
FIG. 32 is a schematic diagram illustrating the power transmission coil assembly, according to the fourth embodiment.

The first-end coil unit 331 is connected to one end portion of the intermediate coil unit 330. The first-end coil unit 331 includes a first return wiring part 351 (i.e., an end transmission coil portion serving as a power transmission coil) which is provided to a substrate 350 (i.e., an end substrate serving as part of a transmission-side substrate). As shown in. FIG. 32, when the first-end coil unit 331 is connected to one end portion of the intermediate coil unit 330, the first return wiring part 351 establishes connection between the first and second coil wiring parts 341 and 342 of the intermediate coil unit 330, while permitting the first and second coil wiring parts 341 and 342 to turn round. Similar to the first and second coil wiring parts 341 and 342, the first return wiring part 351 is formed such as of a copper sheet, a copper wire or a printed wiring. By connecting the first-end coil unit 331 to one end portion of the intermediate coil unit 330, the first and second coil wiring parts 341 and 342 of the intermediate coil unit 330 are connected to each other via the first return wiring part 351 of the first-end coil unit 331.

As shown in FIG. 31, the second-end coil unit 332 is connected to an end portion of the intermediate coil unit 330, the end portion being on an opposite side of the first-end coil unit 331. The second-end coil unit 332 includes a second return wiring part 361 which is provided to a substrate 360 (i.e., an end substrate serving as part of the transmission-side substrate), and power supply terminals 362 and 363. The second return wiring part 361 and the terminals 362 and 363 also act as a further end transmission coil portion serving as the power transmission coil.

As shown in FIG. 32, when the second-end coil unit 332 is connected to the other end portion of the intermediate coil unit 330, the second return wiring part 361 establishes connection between the first and second coil wiring parts 341 and 342, on an opposite side of the first return wiring part 351, while permitting the first and second coil wiring parts 341 and 342 to turn round. Similar to the first and second coil wiring parts 341 and 342, the second return wiring part 361 is formed such as of a copper sheet, a copper wire or a printed wiring.

As described above, the intermediate coil unit 330 has end portions to which the first- and second-end coil units 331 and 332 are connected. Thus, as shown in FIG. 32, a single serial-connection coil 370 is formed by the first and second coil wiring parts 341 and 342 of the intermediate unit 330, the first return wiring part 351 of the first-end coil unit 331 and the second return wiring part 361 of the second-end coil unit 332. The serial-connection coil 370 is a sheet-like planar coil formed on the substrates 340, 350 and 360. The single serial-connection coil 370 has one end to which the power supply terminal 362 is provided and the other end to which the power supply terminal 363 is provided. The power supply terminals 362 and 363 are provided to the second-end coil unit 332. Similar to the first coil wiring part 341 and the like, the power supply terminals 367 and 363 are formed of a copper sheet, a copper wire or a printed wiring. The power supply terminals 362 and 363 are connected to an external high-frequency power source 371. The high-frequency power source 371 feeds high-frequency electric power to the serial-connection coil 370, so that the single body of the serial-connection coil 370 can function as a power transmission coil for the robot 10C.

As shown in FIGS. 31 and 32, the serial-connection coil 370 may include one intermediate coil unit 330, or may include two or more intermediate coil units 330 being connected to each other. In other words, the number of the intermediate coil units 330 interposed between the first- and second-end coil units 331 and 332 is not limited to one but may be two or more. By adjusting the number of the intermediate coil units 330 to be connected, the length of the serial-connection coil 370 and the length of the power transmission coil assembly 311 can be easily changed. When the intermediate coil units 330 are connected to each other, the first coil wiring part 341 of one intermediate coil unit 330 is electrically connected to the first coil wiring part 341 of the adjacent intermediate coil unit 330. Similarly, the second coil wiring part 342 of one Intermediate coil unit 330 is electrically connected to the second coil wiring part 342 of the adjacent intermediate coil unit 330. The first return wiring part 351 of the first-end coil unit 331 is electrically connected to the first and second coil wiring parts 341 and 342 of the adjacent intermediate coil unit 3:30. The second return wiring part 361 and the power supply terminals 362 and 363 of the second-end coil unit 332 are electrically connected to the first and second coil wiring parts 341 and 342 of the adjacent intermediate coil unit 330. An optionally selected means may be used for the electrically connected portions if only the means can ensure electrical connection.

Figure 33:
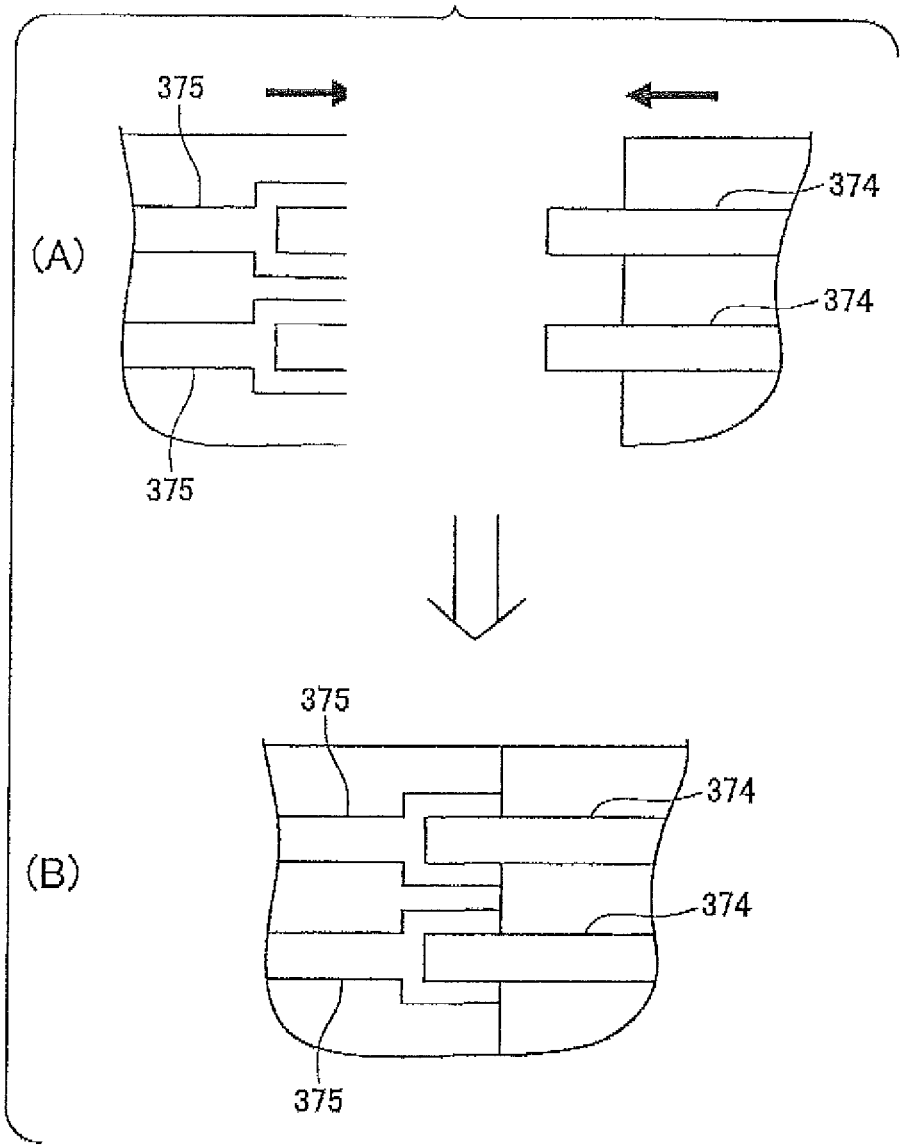
FIG. 33 is an enlarged schematic diagram illustrating a connecting portion of a wiring member in the power transmission coil assembly, according to the fourth embodiment, (A) showing a state where the wiring member is disconnected and (B) showing a state where the wiring member is connected.

For example, as shown in FIG. 33, a wiring member 374, which configures each of the first and second coil wiring parts 341 and 342, the first and second return wiring parts 351 and 361 and the power supply terminals 362 and 363, is engaged with a wiring member 375 to establish electrical connection. Further, in the rear surfaces of the substrates 340, 350 and 360, the wiring members of adjacent units may be electrically connected using conductor wires or the like. Thus, an optionally selected connection style may be used for the wiring members in mutually connecting the Intermediate coil units 330, and in mutually connecting the intermediate coil unit 330 and the first- or second-end coil unit 331 or 332, if only the connection style can ensure electrical connection.

In the power transmission coil assembly 311, the single serial-connection coil 370 is farmed by connecting the first- and second-end coil units 331 and 332 to the intermediate coil unit 330. Thus, the serial-connection coil 370 forms a single coil along the length of the rail member 133 of the power transmission coil assembly 311.

Figure 34:
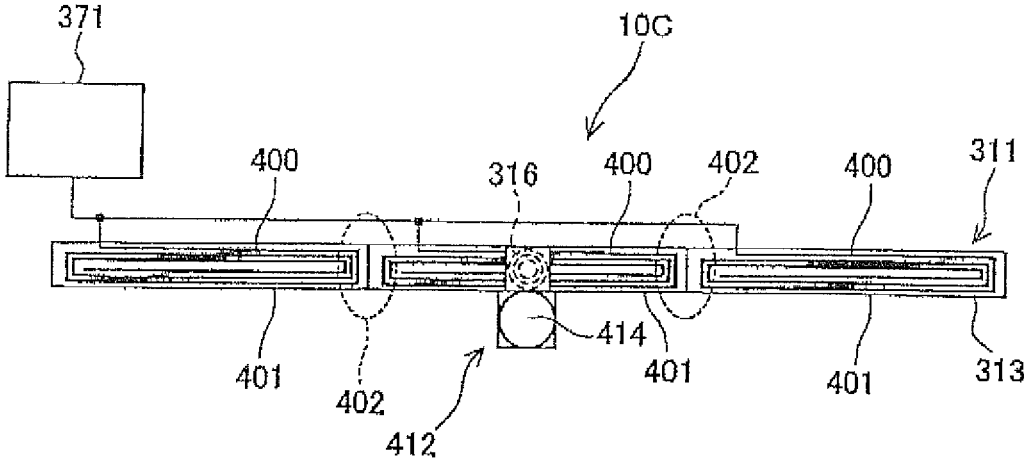
FIG. 34 is a schematic diagram illustrating a power transmission coil assembly, according to a comparative example.

As shown in FIG. 34, when the length of the power transmission coil assembly 311 is extended, coil segments 401 each having a planar coil 400 having a plurality of winding turns may be connected. However, in this case, connection of the coil segments 401 produces regions where the planar coils 400 are absent, at the connected portions, i.e. at boundary portions 402 between the adjacent coil segments 401. In the boundary portions 402 between the coil segments 401, i.e. in the regions where the planar coils 400 are absent, power transmission efficiency between the power transmission side and the power reception coil 316 is reduced to about 80% of the power transmission efficiency in the portions where the planar coils 400 are present. In the robot 10C, the movable member 312 moves along the power transmission coil assembly 311. Accordingly, connection of two or more coil segments 401 produces at least one boundary portion 402 where power transmission efficiency is reduced along the moving direction of the movable member 312.

Figure 30:
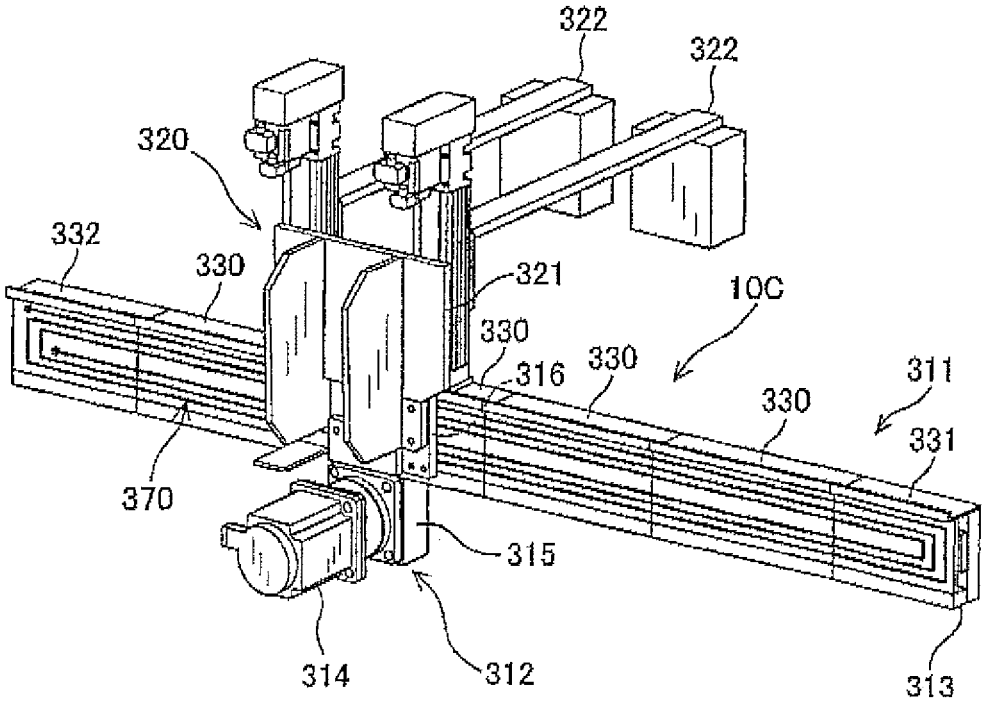
FIG. 30 is a schematic perspective view illustrating the direct drive type robot to which the power transmission coil assembly is applied, according to the fourth embodiment.

In the fourth embodiment, as shown in FIGS. 29 and 30, the single serial-connection coil 370 is formed by mutually connecting the intermediate coil units 330, and the first- and second-end coil units 331 and 332. Therefore, power transmission efficiency between the transmission coil assembly 311 and the power reception coil 316 is stable in the longitudinal direction of the power transmission coil assembly 311. Further, in the fourth embodiment, the length of the power transmission coil assembly 311 can be easily adjusted by changing the number of intermediate coil units 330 to be connected.

In addition, in the fourth embodiment, a capacitor 377 is connected between the serial-connection coil 370 and the high-frequency power source 371. The capacitor 377 configures an LC circuit together with the serial-connection coil 370. Accordingly, by changing the capacity of the capacitor 377, the resonance frequency between the serial-connection coil 370 and the power reception coil 316 can be adjusted.

Hereinafter is described transmission of electric power in the direct drive type robot 10C described above.

The high-frequency power source 371 supplies high-frequency alternating current ranging from several MHz to several tens of MHz to the serial-connection coil 370 to establish magnetic resonance. For example, the high frequency supplied by the high-frequency power source is set to an optionally selected value for establishing magnetic resonance, depending on the characteristics of the serial-connection coil 370 and the power reception coil 316. When electric power is fed from the high-frequency power source 371 to the serial-connection coil 370, magnetic resonance occurs at a portion in which the serial-connection coil 370 and the power reception coil 316 are positioned face to face. Accordingly, the power reception coil 316 receives electric power from the serial-connection coil 370 via the magnetic resonance. On the other hand, when electric power is supplied to the serial-connection coil 370 but the serial-connection coil 370 and the power reception coil 315 are not positioned face to face, unnecessary electric field and magnetic field are not emitted from the serial-connection coil 370. In other words, when electric power is fed to the serial-connection coil 370, transmission and reception of electric power is performed based on the magnetic resonance at a portion in which the serial-connection coil 370 and the power reception coil 316 are positioned face to face. In contrast, at a portion in which the serial-connection coil 370 and the power reception coil 316 are not positioned face to face, transmission and reception of electric power is not performed, and thus electric field and magnetic field are hardly emitted.

Again, the reasons for this are that a high-and-low impedance relationship is established between the serial-connection coil 370 and the power reception coil 316.

As described above, in the fourth embodiment, the electric power needed by the movable side is fed in a non-contact manner based on the magnetic resonance that occurs between the power transmission coil assembly 311 and the power reception coil 316. Thus, the basic advantageous effects of the first embodiment described above can be enjoyed.

In the fourth embodiment, one or more intermediate coil units 330 are connected to optionally set the length of the power transmission coil. The one or more intermediate coil units 330 are connected to the first- and second-end coil units 331 and 332 to form a single roll of the serial-connection coil 370, extending from the first-end coil unit 331 to the second-end coil unit 332 with the interposition of the intermediate coil units 330. In other words, the serial-connection coil 370 is set to an optionally selected length by adjusting the number of intermediate coil units 330 to be connected. Accordingly, the length of the power transmission coil can be easily changed.

[Fifth Embodiment]

Figure 35:
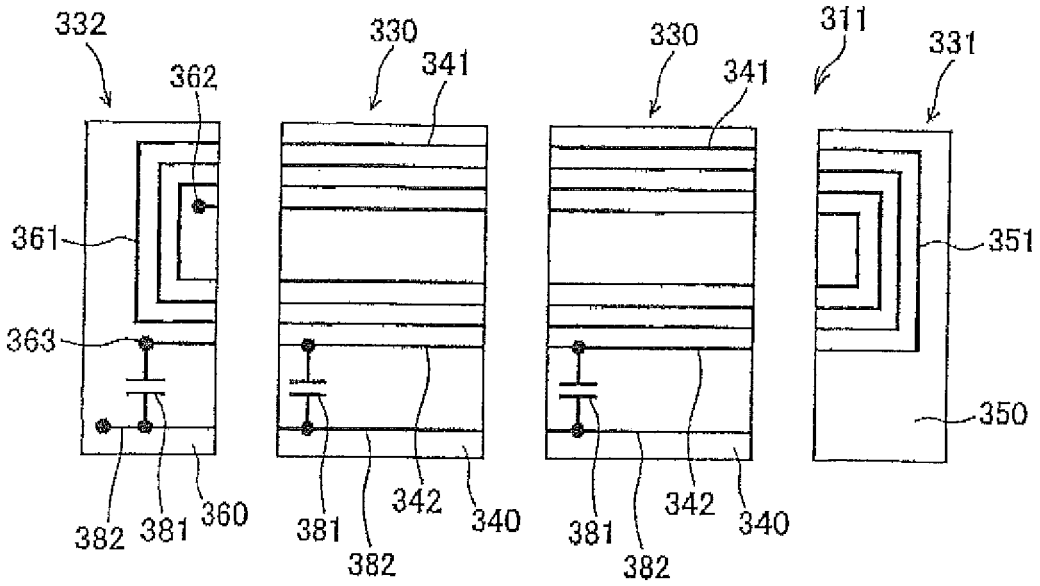
FIG. 35 is a schematic exploded view illustrating a power transmission coil assembly, according to a fifth embodiment of the present invention.
Figure 36:
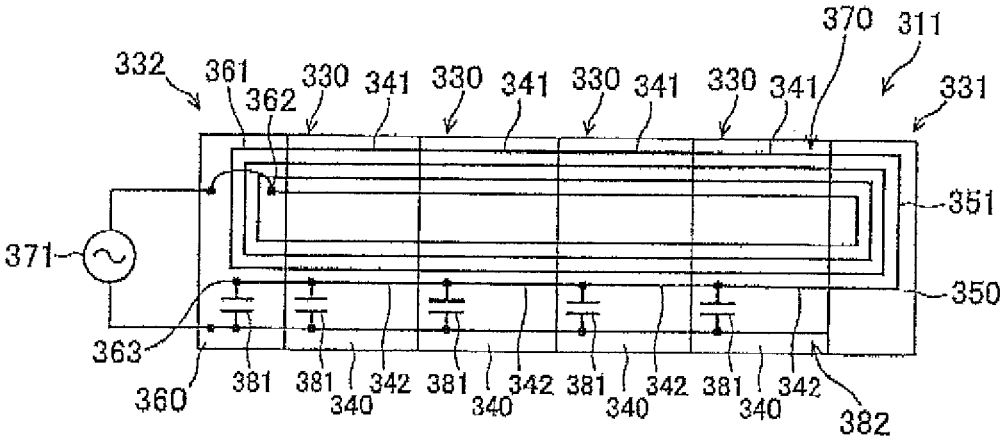
FIG. 36 is a schematic diagram illustrating the power transmission coil assembly, according to the fifth embodiment.
Figure 37:
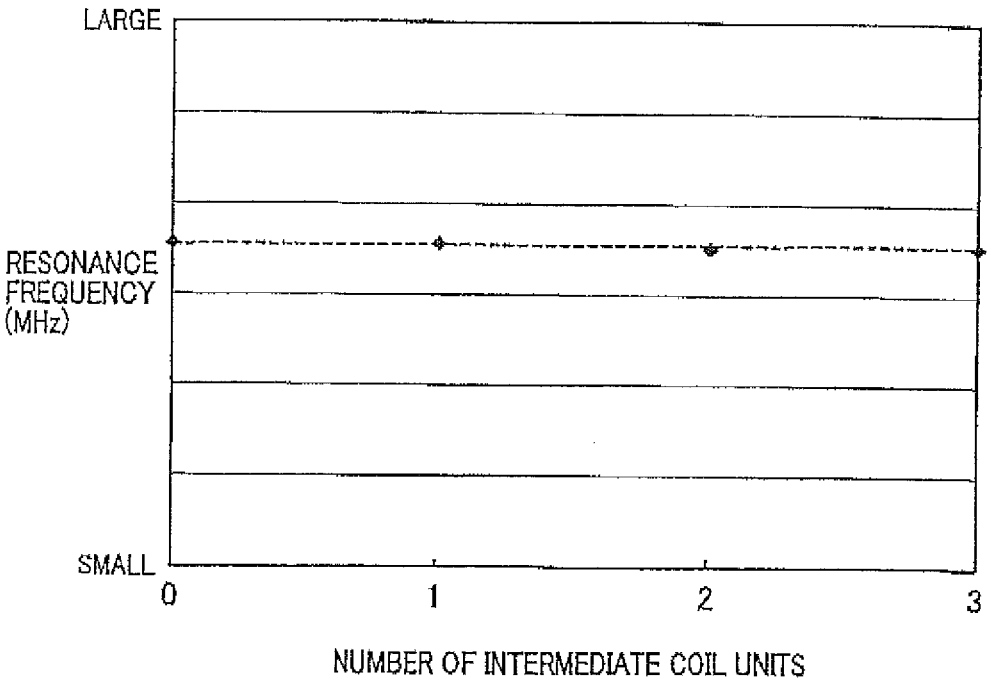
FIG. 37 is a schematic diagram illustrating a relationship between the number of intermediate coil units and resonance frequency in the power transmission coil assembly, according to the fifth embodiment.

Referring to FIGS. 35 to 37, hereinafter is described a fifth embodiment of a wireless power transmission apparatus and a direct drive type system including the apparatus.

FIGS. 35 and 36 show a power transmission coil assembly 311 installed in a direct drive type robot as a direct drive type system according to the fifth embodiment.

In the fifth embodiment and its modifications, the components identical with or similar to those in the fourth embodiment are given the same reference numerals.

In the fifth embodiment, the power transmission coil assembly 311, which is provided as part of a wireless power transmission apparatus, includes a capacitor 381. Specifically, the intermediate coil unit 330 and the second-end coil unit 332 configuring the power transmission coil assembly 311 each include the capacitor 381. In the intermediate coil unit 330, the capacitor 381 is connected to the first or second coil wiring part 341 or 342 that configures the serial-connection coil 370. The capacitor 381 is inserted into the serial-connection coil 370 and a power supply wiring part 382 which is parallel to the serial-connection coil 370. Similar to the first coil wiring part 341 or the like described above, the power supply wiring part 382 is provided to each of the substrates 340 and 360. When the intermediate coil unit 330 and the second-end coil unit 332 are connected, the power supply wiring parts 382 are electrically connected to each other.

When the capacitor 381 is connected to the intermediate coil unit 330, the intermediate coil unit 330 solely forms a quasi-LC circuit. Similarly, when the capacitor 381 is connected to the second-end coil unit 332, the second-end coil unit 332 solely forms a quasi-LC circuit. These capacitors 381, with the change of their capacities, enable adjustment of the resonance frequency for each of the intermediate coil unit 330 and the second-end coil unit 332.

When the intermediate coil units 330 are mutually connected to form a single serial-connection coil 370 as in the fifth embodiment, the capacitor 377 shown in FIG. 32 may be connected after formation of the serial-connection coil 370 and then the resonance frequency may be adjusted. In other words, one or more capacitors 377 may be connected to a single serial-connection coil 370 for the adjustment of the resonance frequencies. However, the intermediate coil units 330 are mutually connected in the facility where the direct drive type robot 10 is set up. It takes about several hours to several days for the mutual connection of the intermediate coil units 330 in the facility where the robot 10 is set up and adjusting the resonance frequencies thereafter.

In this regard, according to the fifth embodiment, the capacitor 381 is connected in advance to each of the intermediate coil unit 330 and the second-end coil unit 332. Accordingly, the resonance frequency of the intermediate coil unit 330 or the second-end coil unit 332 as a sole unit is adjusted in advance. In other words, the resonance frequencies of the intermediate coil unit 330 and the second-end coil unit 332 are adjusted in advance on a unit basis. Therefore, when the direct drive type robot is set up in a facility, the intermediate coil units 330, and the first- and second end coil units 331 and 332 only have to be connected with each other, without involving the adjustment of the resonance frequencies. In the fifth embodiment, as shown in FIG. 37, even when the number of the intermediate coil units 330 to be connected is increased, the resonance frequency is substantially stable.

In the fifth embodiment, the intermediate coil unit 330 and the second-end coil unit 332 each include the capacitor 381 for adjusting resonance frequency. Thus, the resonance frequencies of the intermediate coil unit 330 and the second-end coil unit 332 are adjusted in advance on a unit basis by the respective capacitors 381 connected. As a result, if only connection is established between the intermediate coil unit 330 and the second-end coil unit 332, in which the resonance frequencies are adjusted in advance, there is no need of adjusting the resonance frequencies after the connection. Accordingly, when the length of the power transmission coil is changed, the resonance frequencies can be easily adjusted, thereby simplifying the work involved in the connection.

(Modifications)

For example, the wiring parts do not necessarily have to be made of copper but may be made of an optionally selected electrically conductive material. Further, the shape of the power transmission coil assembly 311 is provided by way of example only and thus may be optionally changed.

What is claimed is:

1. A direct drive type of system, comprising:

a rail member;

a movable member comprising a moving member held by the rail member and movable along the rail member and an electric motor driven by the moving member;

a power transmission coil comprising a plurality of power transmission coil segments each composed of a planar coil and cascade-arranged along the rail member with a coil-less region provided between two of the mutually adjacent transmission coil segments, wherein high-frequency current is supplied to the power transmission coil segments from a power source;

a power reception coil arranged in the movable member so as to be opposed to the power transmission coil via a gap, wherein the power reception coil is formed as a planar coil having an area opposed to each of the power transmission coil segments and the area of the power reception coil is smaller than an area of each of the power transmission segments, wherein power to be fed to the motor is non-contact transmitted from the power transmission coil to the power reception coil by a magnetic resonance phenomenon.

2. The direct drive type of system of claim 1, wherein the rail member comprises a transmission-side substrate on which the power transmission coil is formed and a holding member configured to be engaged with the moving member and movably to hold the moving member, and the movable member comprises a reception-side substrate on which the power reception coil is formed.

3. The direct drive type of system of claim 2, wherein the transmission-side and reception-side substrates are tabular substrates, the rail member and the movable member are formed on the tabular substrate, the tabular substrate has two surfaces, the power transmission coil or the power reception coil being formed on one of the two surfaces, a tabular electrode member being arranged along the one of the two surfaces, the tabular substrate functioning as a dielectric material to form a capacitor therebetween.

4. The direct drive type of system of claim 3, wherein the tabular electrode member is divided into a plurality of tabular electrode members.

5. The direct drive type of system of claim 2, wherein the reception-side substrate comprises a frontal substrate located to be opposed to a front surface of the transmission-side substrate on which the power transmission coil is formed and configured movably along the rail member, and a rear substrate located to be opposed to a rear surface of the transmission-side substrate which is positioned back-to-back to the front surface and configured movably along the rail member; and the reception coil comprises a frontal reception coil formed on a surface of the frontal substrate which is opposed to the transmission-side substrate, and a rear reception coil formed on a surface of the rear substrate which is opposed to the transmission-side substrate.

6. The direct drive type of system of claim 5, wherein the frontal and rear reception coils both are composed of planar coils and wound to produce a mirror-image relationship via the transmission-side substrate.

7. The direct drive type of system of claim 2, wherein the transmission-side substrate comprises two end substrates respectively located at both end portions thereof, and one or more intermediate substrates located between the two end substrates, the two end substrates and any of the intermediate substrates being configured to be engaged with each other to produce a single transmission-side substrate, the transmission coil comprises two end transmission coil portions formed on the two end substrates respectively and configured to function as two end portions of the transmission coil respectively, and one or more intermediate transmission coil portions formed on the one or more intermediate substrates respectively and configured to electrically connect the two end transmission coil portions with each other, mutually engaging the two end substrates and the intermediate substrates allowing the two end transmission coil portions and the intermediate transmission coil portions to be connected electrically with each other so as to produce a single transmission coil segment.

8. The direct drive type of system of claim 7, wherein the single transmission coil segment is electrically connected to a capacitor at a part the segment so as to adjust a resonance frequency of the single transmission coil segment.

9. The direct drive type of system of claim 2, wherein each of the plurality of power transmission coil segments is formed by winding, one turn or plurality of turns, a conductor along an elongated winding pattern, the power reception coil is formed by winding a conductor, one turn or plurality of turns, along a circular or square winding pattern, each of the power transmission coil segments has a coil area defined as an inside area encircled by outermost turn of the wound turns of each of the power transmission coil segments, and the power reception coil has a coil area opposed to the coil area of each of the coil areas of the power transmission coil segments and smaller than the inside area of the outermost turn of the respective power transmission coil segments.

10. The direct drive type of system of claim 9, wherein the transmission-side substrate is composed of a plurality of elongated rectangular transmission-side substrates on which the plurality of power transmission coil segments are formed respectively, the plurality of transmission-side substrates are cascade-connected along a moving direction of the movable member, and the plurality of power transmission coil segments are connected parallel with the power source.

11. A wireless power transmission apparatus for a direct drive type of system comprising:

a rail member;

a movable member comprising a moving member held by the rail member and movable along the rail member and an electric motor driven by the moving member;

a power transmission coil comprising a plurality of power transmission coil segments each composed of a planar coil and cascade-arranged along the rail member with a coil-less region provided between two of the mutually adjacent transmission coil segments, wherein high-frequency current is supplied to the power transmission coil segments from a power source; and a power reception coil arranged in the movable member so as to be opposed to the Power transmission coil via a gap, wherein the power reception coil is formed as a planar coil having an area opposed to each of the power transmission coil segments and the area of the power reception coil is smaller than an area of each of the power transmission segments, wherein power to be fed to the motor is non-contact transmitted from the power transmission coil to the power reception coil by a magnetic resonance phenomenon, and a tabular substrate;

a tabular coil member arranged on one of two surfaces of the substrate, the one surface being a front surface; and a tabular electrode member arranged on the other of the two surfaces of the substrate, the other surface being a rear surface, the electrode member layering the substrate with the coil member to produce a capacitor.

12. A wireless power transmission apparatus for a direct drive type of system, comprising:

a rail member;

a movable member comprising a moving member held by the rail member and movable along the rail member and an electric motor driven by the moving member;

a power transmission coil comprising a plurality of power transmission coil segments each composed of a planar coil and cascade-arranged along the rail member with a coil-less region provided between two of the mutually adjacent transmission coil segments, wherein high-frequency current is supplied to the power transmission coil segments from a power source; and a power reception coil arranged in the movable member so as to be opposed to the power transmission coil via a gap, wherein the power reception coil is formed as a planar coil having an area opposed to each of the power transmission coil segments and the area of the power reception coil is smaller than an area of each of the power transmission segments, wherein power to be fed to the motor is non-contact transmitted from the power transmission coil to the power reception coil by a magnetic resonance phenomenon, and the apparatus comprising:

a power transmission unit positionally fixed and configured to have a substrate and a power transmission coil formed on one of two surfaces of the substrate, the one surface being a front surface of the substrate, and a power reception unit movable along the power transmission coil and configured to have i) a first planar coil opposed to the power transmission coil in a non-contact manner on a front side of the substrate and ii) a second planar coil opposed to a rear side of the substrate in a non-contact mariner, wherein the power reception unit receives power from the power transmission unit due to the magnetic resonance phenomenon caused therebetween.

13. The wireless power transmission apparatus of claim 12, wherein the first and second planar coils are wound in a mirror image via the substrate.

14. A wireless power transmission apparatus for a direct drive type of system comprising:

a rail member;

a movable member comprising a moving member held by the rail member and movable along the rail member and an electric motor driven by the moving member;

a power transmission coil comprising a plurality of power transmission coil segments each composed of a planar coil and cascade-arranged along the rail member with a coil-less region provided between two of the mutually adjacent transmission coil segments wherein high-frequnecy current is supplied to the power transmission coil segments from a power source; and a power reception coil arranged in the movable member so as to be opposed to the power transmission coil via a gap, wherein the power reception coil is formed as a planar coil having an area opposed to each of the power transmission coil segments and the area of the power reception coil is smaller than an area of each of the power transmission segments, wherein power to be fed to the motor is non-contact transmitted from the power transmission coil to the power reception coil by a magnetic resonance phenomenon, and an intermediate coil unit comprising a first liner coil wiring part and a second liner coil wiring part which is parallel with the first liner coil wiring part;

a first end coil unit comprising a first return wiring part connected to one of two ends of the one or more intermediate coil units mutually connected, such that the first and second liner coil wiring parts of the intermediate coil units are connected with each other via the first return wiring part; and a second end coil unit comprising:

a second return wiring part connected to the other of the two ends of the one or more intermediate coil units mutually connected, such that the first and second liner coil wiring parts of the intermediate coil units are connected with each other via the second return wiring part, and power supply terminals arranged at two ends of a single serial-connection coil formed by mutually connecting the first liner coil wiring part, the second liner coil wiring part, the first return wiring part, and the second return wiring part and configured relay power the single serial-connection coil.

15. The wireless power transmission apparatus of claim 14, wherein the intermediate coil units and the second end coil unit comprise capacitors connected to be connected to the serial-connection coil, the capacitors being for adjusting a resonance frequency of the magnetic resonance.

16. The direct drive type of system of claim 1, wherein the power reception coil is composed of a single power reception coil.

17. The direct drive type of system of claim 1, wherein the power reception coil has a width that is shorter than a width of each of the plurality of power transmission coil segments in a moving direction of the movable member.

* * * * *